US012497778B2

(12) United States Patent
Chambery

(10) Patent No.: US 12,497,778 B2
(45) **Date of Patent: *Dec. 16, 2025**

(54) DOWNSPOUT GUARD, KIT THEREFOR, AND METHOD OF ASSEMBLY

(71) Applicant: Brook Allen Chambery, Rochester, NY (US)

(72) Inventor: Brook Allen Chambery, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/662,438

(22) Filed: May 9, 2022

(65) Prior Publication Data

US 2022/0356709 A1 Nov. 10, 2022

Related U.S. Application Data

(60) Provisional application No. 63/232,262, filed on Aug. 12, 2021, provisional application No. 63/185,392, filed on May 7, 2021.

(51) Int. Cl.
*E04D 13/076* (2006.01)

(52) U.S. Cl.
CPC ..... *E04D 13/0767* (2013.01)

(58) Field of Classification Search
CPC ..... E04D 2013/086; E04D 13/076; E04D 13/0767
See application file for complete search history.

(56) References Cited

U.S. PATENT DOCUMENTS 2,175,138 A * 10/1939 Westlake, Jr. ..... E04D 13/076 52/12
2,533,402 A 12/1950 Schmitz, Jr.
4,965,969 A * 10/1990 Antenen ..... E04D 13/076 52/12
5,230,798 A * 7/1993 Rogman ..... B01D 29/96 52/12
5,242,591 A 9/1993 Beechert et al.
5,535,554 A * 7/1996 Harris, Jr. ..... E04D 13/0409 52/12
5,536,406 A * 7/1996 Silva ..... B01D 29/902 52/12
5,960,590 A 10/1999 Hutchison
D425,182 S 5/2000 Vargas
(Continued)

OTHER PUBLICATIONS

U.S. Pat. No. 316,578 B1 Apr. 28, 1885 to Schumann et al.—Form would not accept the number of this US Patent in any form.

(Continued)

*Primary Examiner* — Jessica L Laux
(74) *Attorney, Agent, or Firm* — TROUTMAN PEPPER LOCKE LLP

(57) ABSTRACT

A downspout guard having opposed sidewalls and opposed end walls connected to a top wall, all formed from mesh material, such as metal mesh. Bottom edges of the walls engage a gutter bottom wall to hold the guard in place and forcing water to flow through the guard before entering the downspout. The sidewalls can engage gutter front/back walls, further holding the guard in place. Trapped debris enhances further debris entrapment, even trapping particles smaller than the mesh opening. Optionally, end walls taller than the sidewalls to accommodate obstructions and allow height adjustment by relative angle changes.

21 Claims, 25 Drawing Sheets

(56) References Cited

U.S. PATENT DOCUMENTS

| | | | | |
|---|---|---|---|---|
| 6,193,880 | B1 | 2/2001 | Bergeron | |
| 6,223,474 | B1 | 5/2001 | Kafton | |
| 6,293,054 | B1 | 9/2001 | Cangialosi | |
| 6,594,956 | B1 | 7/2003 | Willing | |
| D606,174 | S | 12/2009 | Martin | |
| 8,646,217 | B2 | 2/2014 | Ratajac | |
| 8,656,647 | B2 | 2/2014 | Bath et al. | |
| 9,127,463 | B1 * | 9/2015 | Feldhaus | E04D 13/076 |
| 9,388,559 | B2 * | 7/2016 | Robertson | E04D 13/0767 |
| 9,643,113 | B2 | 5/2017 | Farmer et al. | |
| 10,519,667 | B1 * | 12/2019 | Ealer, Sr. | B21D 47/005 |
| 2004/0006927 | A1 * | 1/2004 | Wickett | E03F 3/046 52/12 |
| 2005/0034376 | A1 | 2/2005 | Pourdeyhimi et al. | |
| 2006/0191208 | A1 * | 8/2006 | MacIntyre | E04D 13/0767 52/12 |
| 2006/0278573 | A1 | 12/2006 | Robinson | |
| 2020/0154887 | A1 * | 5/2020 | Nilsson | A47B 45/00 |

OTHER PUBLICATIONS

U.S. Pat. No. 571,711 B1 Nov. 17, 1896 to Twist—Form would not accept the number of this US Patent in any form.

* cited by examiner

DOWNSPOUT GUARD, KIT THEREFOR, AND METHOD OF ASSEMBLY

BACKGROUND

The invention relates generally to water runoff handling systems for buildings that include gutters and downspouts. More specifically, the invention relates to devices aiming to eliminate or at least significantly reduce entry of debris into downspouts of such systems, particularly in the context of roof gutter systems.

Various approaches to preventing debris from entering downspouts exist with the goal of avoiding clogging of downspouts and downstream hardware that can occur when debris is allowed to enter downspouts from gutters. Some of these are more successful than others, but all of them tend to allow too much debris to enter the downspout as they attempt to maintain drainage capacity and clog too easily, which can lead to water backup and overflow problems if the guards and the areas directly surrounding them are not constantly cleaned. While it is unlikely that maintenance or cleaning could be eliminated, a downspout guard is desirable that prevents even minute debris from entering the downspout, preserves maximum water drainage with even maximum buildup of debris , requires minimal cleaning of the gutter, is easy to install and remove when the gutter does need cleaning, is safe for hands and gutters, maintains functionality with a wide variety of downspout shapes and sizes, and is functional year round, including through ice and snow. Additionally, it is desirable to have such a guard available in a relatively compact, easy-to-assemble kit.

SUMMARY

Embodiments of the invention disclosed herein may include a downspout guard having five walls formed from at least one piece of a mesh material and including two opposed sidewalls including a front sidewall and a back sidewall, two opposed end walls that primarily provide filtration and secondarily provide drainage, and a top wall connected to the sidewalls and end walls and that primarily provides drainage while secondarily providing filtration, wherein when installed in a gutter that includes opposed front and back walls connected to a bottom wall, bottom surfaces of at least the end walls engage the gutter bottom wall, and during operation, at least the two opposed end walls provide filtration to block passage of debris and smaller particles to form a filter cake.

Additionally, embodiments of the invention disclosed herein can include five walls formed from at least one piece of a mesh material having a short way of design of no more than 0.25", a long way of design of no more than 0.40", and a ratio of open area of at least from 60% to 65%. Among the five walls can be two opposed sidewalls including a front sidewall and a back sidewall, two opposed end walls, and a top wall connected to the sidewalls and end walls, wherein, when installed in a gutter that includes a bottom wall, bottom surfaces of at least the end walls engage the gutter bottom wall.

Further, embodiments of the invention disclosed herein also contemplate a method of reducing debris flow to a downspout including providing opposed end walls, opposed sidewalls, and a top wall of a mesh material, and connecting the end walls to the opposed sidewalls and the top wall to form a downspout guard with at least the opposed end walls primarily providing filtration and the top wall primarily providing drainage. The method can also include ensuring each mesh opening of the mesh material has a diamond shape relative to the top wall, the diamond shape having a long axis substantially parallel to a plane of the top wall of the downspout guard. Additionally, placing the downspout guard in a gutter over a downspout such that the downspout is under a center of the top wall can be included in such a method, as can placing the downspout guard such that bottom edges of at least the opposed end walls engage a gutter bottom wall, thereby impeding progress of debris into the downspout while allowing water to proceed to the downspout. According to such a method, at least the end walls of the guard can collect particles during operation to form respective filter cakes that further enhance filtration.

An embodiment of the invention disclosed herein can include a top wall and two opposed end walls formed from at least one piece of mesh material, the two opposed end walls being perpendicular to the top wall and having bottom edges engaging a bottom wall of a gutter in which it is installed.

Another embodiment of the invention disclosed herein can include a kit for assembling a downspout guard. The kit can include at least one piece of mesh material to form a top wall, two opposed sidewalls, and two opposed end walls. The kit can further include means for attaching walls of the downspout guard to each other and instructions for performing a method of assembly of the downspout guard. The method can include arranging the at least one piece of mesh material into the top wall, the two opposed sidewalls, and the two opposed end walls and attaching at least one of the walls to at least one other wall.

A further embodiment of the invention disclosed herein can include a method of reducing debris flow to a downspout that can include providing opposed end walls and a top wall of a mesh material, and connecting the end walls to the top wall to form a downspout guard. The method can also include ensuring each mesh opening of the mesh material in the opposed end walls has a diamond shape relative to the top wall, and that the diamond shape of the opposed end walls having a long axis substantially parallel to a plane of the top wall of the downspout guard. Further, the method can include placing the downspout guard in a gutter over a downspout such that the downspout is under a center of the top wall, thereby impeding progress of debris into the downspout while allowing water to proceed to the downspout.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings.

FIGS. 24, and 25 are isometric views of implementations of the examples of a downspout guard in a K-style gutter according to embodiments of the invention disclosed.

FIG. 26 is a side view of an implementation of a downspout guard according to embodiments of the invention disclosed herein.

DETAILED DESCRIPTION

Figure 1:
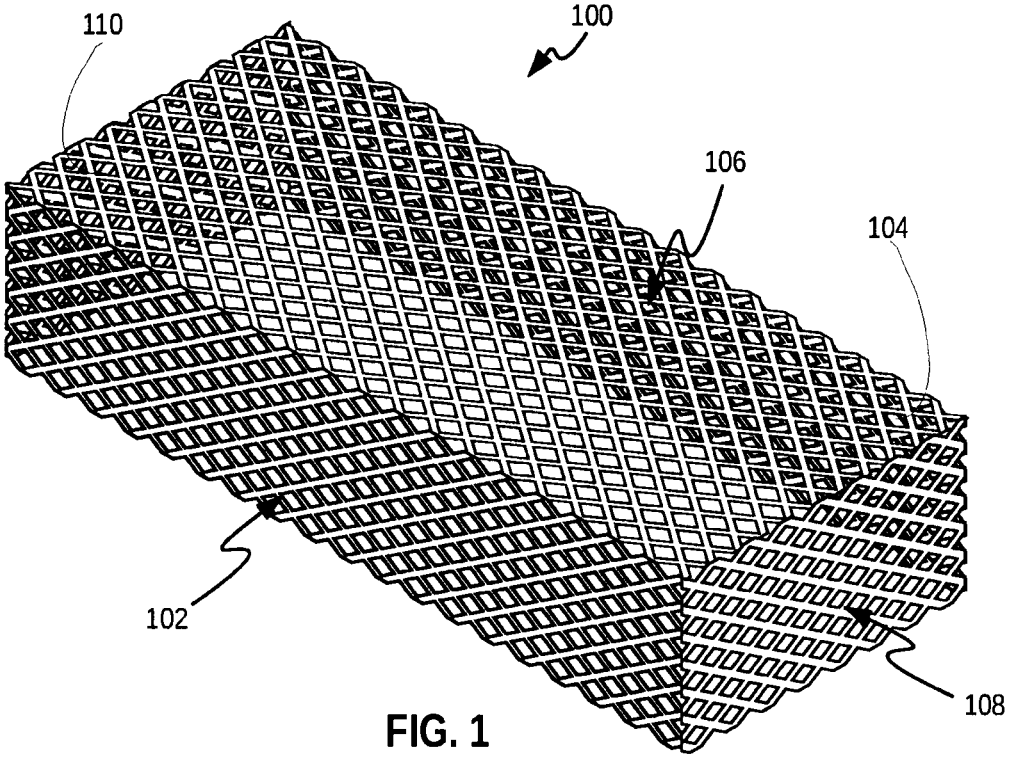
FIGS. 1, 2, 9, 10, 13-15, 17, 18, 20-25, and 27 are isometric views of examples of a downspout guard according to embodiments of the invention disclosed herein.

Embodiments of the present invention are directed to a downspout guard that sits over an opening for a downspout in a gutter, methods of making such a guard, and a kit including pieces and/or components to form such a guard.

Preferably, the walls of the guard are made from a diamond-shaped mesh, an expanded metal mesh has been found to be particularly effective, though other materials could be used, such as plastic or perforated metal. Experiments have found that diamond-shaped mesh with a short way of design (SWD—the length of short diamond diagonal from one pitch point center to another pitch point center) of no more than 0.25", a long way of design (LWD—the length of long diamond diagonal from one pitch point center to another pitch point center) of no more than 0.40", and a ratio of open area of at least from 60% to 65% provides suitable performance. Where expanded metal mesh is used, it can be advantageous to use powder coated carbon steel expanded metal mesh to provide the preferred strength, weight, and rigidity.

In other words, the finished guard preferably includes five sides or walls, with a horizontal top wall, vertical sidewalls, and vertical end walls. That is, the guard can have two opposed sidewalls connected to two opposed end walls and to a top wall to form a five-sided hollow polyhedron. Each wall can be made from a mesh material, such as a metal mesh or a plastic mesh. That is, in embodiments, two opposed sidewalls, two opposed end walls, and a top wall are all connected to form a five-sided hollow polyhedron. In embodiments, a powder coated metal mesh can be used, particularly such a mesh that is fairly rigid. Expanded metal mesh can be particularly advantageous in embodiments for its durability and relatively high strength to weight ratio. In addition, in embodiments, various walls, all of the walls, and/or portions of walls of embodiments can be made from a single piece of mesh material. For example, the opposed sidewalls and top wall can be formed from a single piece of mesh material bent into a squared-off U-shape. In an additional example, the top wall can be one piece of mesh material, the side walls can each be part of a respective piece of mesh material, and the opposed end walls can be formed from respective pieces of mesh material.

In some embodiments, to avoid possible obstructions such as downspout collars and caulking, at least one notch 103 (FIG. 2) can be formed in the bottom portion(s) of at least one sidewall, the end walls and sidewalls being of substantially equal height. In addition, preferred embodiments can have one of the opposed sidewalls engaging at least part of the gutter front wall with the other of the opposed sidewalls engaging the gutter back wall, the opposed sidewalls thus holding the downspout guard in the gutter. Preferably, the guard is held in place by a slight interference fit in which the end walls and top wall are slightly wider than the bottom of the gutter so that light force is required to place the guard in position. In this description, this slight interference fit may also be referred to as a snug fit. In additional embodiments, the guard can sit in the gutter with the sidewalls separated from the gutter front and back walls and the guard sidewalls and end walls holding the guard in place. Embodiments can also include an optional retainer to add positional security for the guard as will be described. Embodiments can block dirt and debris from entering the downspout, which can greatly reduce the risk of any blockage further downstream, or in the downspout, which could otherwise create damming of water year-round, and ice problems in the winter. Thus, it can be very advantageous to leave the unit in place year-round.

In the five-walled guard of embodiments, all of the walls are important to the operation of the guard to maximize drainage while maximizing blockage of debris from passing into the downspout. The sidewalls and end walls primarily stop debris, whereas the top wall provides significant additional drainage area that is important in times of heavy flow in the gutter, such as during heavy rain. That is, the end walls provide drainage and are responsible for filtration, including both large and minute particles, while the top wall provides filtration, primarily of larger debris, and augments and ensures maximum rate of flow and drainage capacity. In other words, the sidewalls and end walls primarily provide filtration while secondarily providing drainage, and the top wall primarily provides drainage while secondarily providing filtration, such as when water level in the gutter in which the guard is installed exceeds the height of the guard. Such high water level can occur from buildup of material against the end walls and sidewalls and/or during extreme rainfall, for example. The unexpected and surprisingly effective results of experiments are particularly illustrated in FIGS. 34-49. It is believed that the combination of the vertical orientation of the sidewalls and end walls and the use of a mesh contribute to the inventive guard's filtration ability, blocking debris and particles smaller than the mesh opening and creating filter cakes. It is also believed that the preferred orientation of the mesh with the long axis of diamond openings parallel to the plane of the top wall further contributes to the inventive guard's filtration ability, and even more so when the preferred expanded metal mesh material is used.

Figure 2:
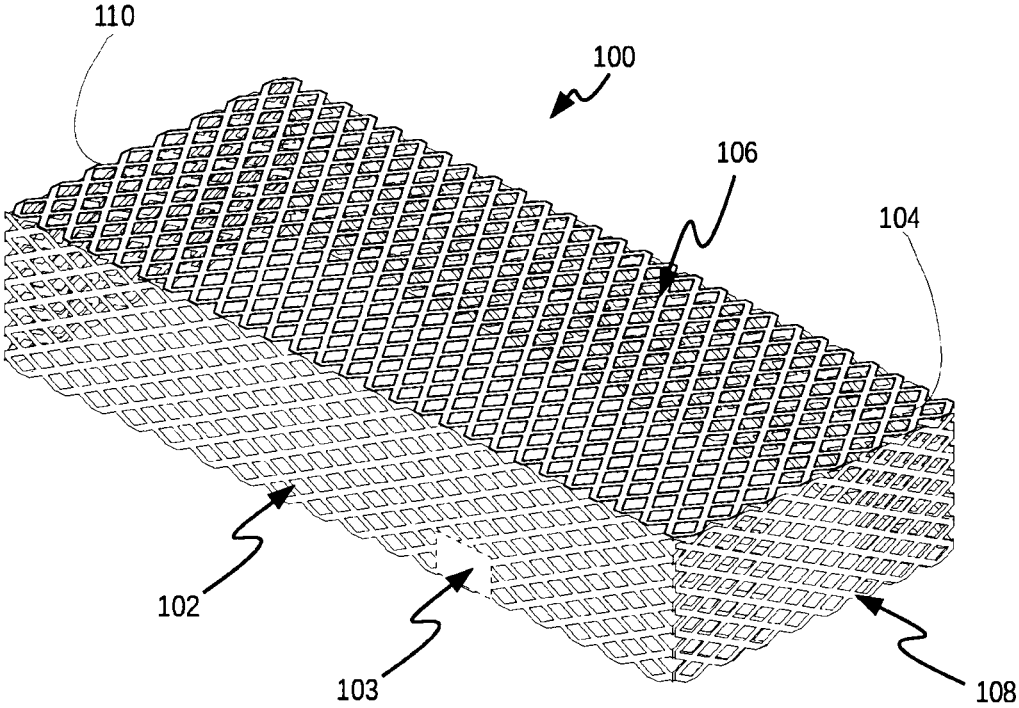
Figure 3:
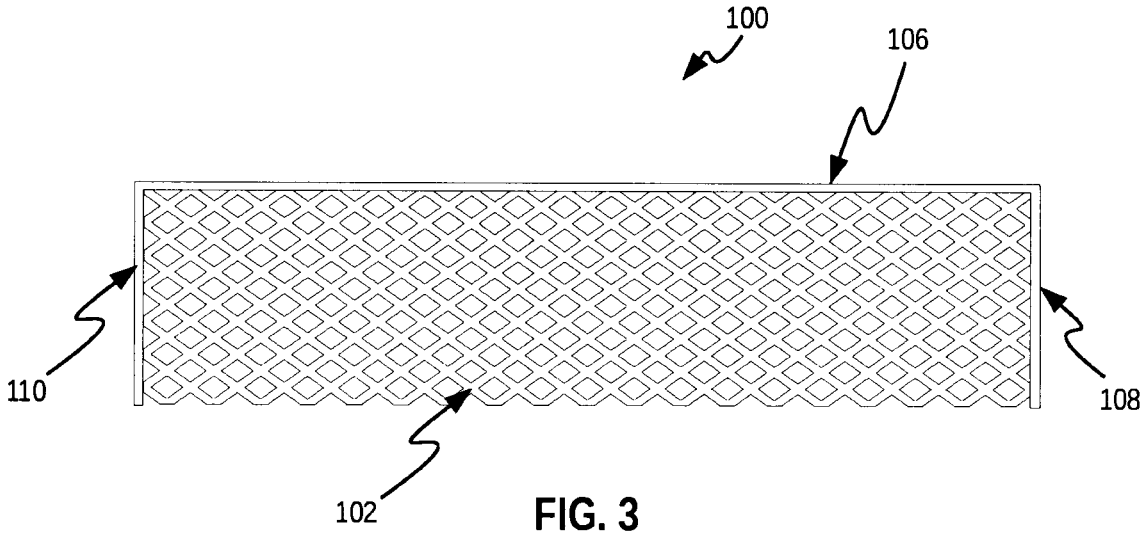
FIGS. 3, 26 and 28 are side views of examples of a downspout guard according to embodiments of the invention disclosed herein.
Figure 4:
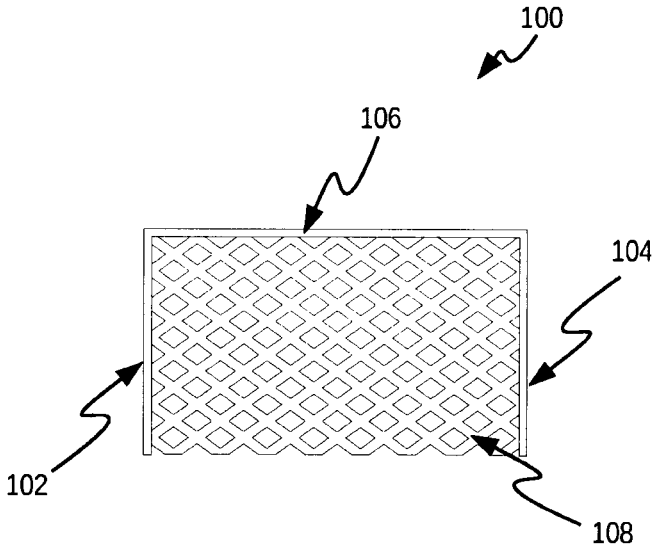
FIG. 4 is an end view of an example of a downspout guard according to embodiments of the invention disclosed herein.

More particularly, with reference to FIGS. 1-4, a downspout guard 100 according to embodiments can include opposed sidewalls, such as a front sidewall 102 and a back sidewall 104. Front and back sidewalls 102, 104 can be opposed to each other and spaced apart by a width of a top wall 106 connected to top edges of the front and back sidewalls 102, 104. Embodiments can also include opposed end walls, such as first end wall 108 and second end wall 110, disposed at opposite ends of top wall 106, as well as at opposite ends of front and back sidewalls 102, 104. In embodiments, opposed end walls 108, 110 can have a width equal to the width of top wall 106 and all of walls 102, 104, 108, 110 can have a same height, as seen in FIGS. 1 and 2, for example. Preferably, the width of top wall 106 and thus guard 100 is selected to provide a slight interference fit between downspout guard 100 and front and back walls of a gutter into which guard 100 may be installed as will be described more fully below. However, experiments have shown that even when sidewalls 102, 104 are separated from gutter front and back walls by a gap, such as up to ¼", guard 100 can remain in place in even extremely heavy rainfall.

In embodiments in which notches 103 are formed in sidewalls 102, 104, guard 100 can span obstructions, such as lips of the downspout, caulk, and/or structural or other features or objects in the gutter, such as gutter components or accessories, or a piece of mesh material covering the downspout opening as discussed above.

Figure 5:
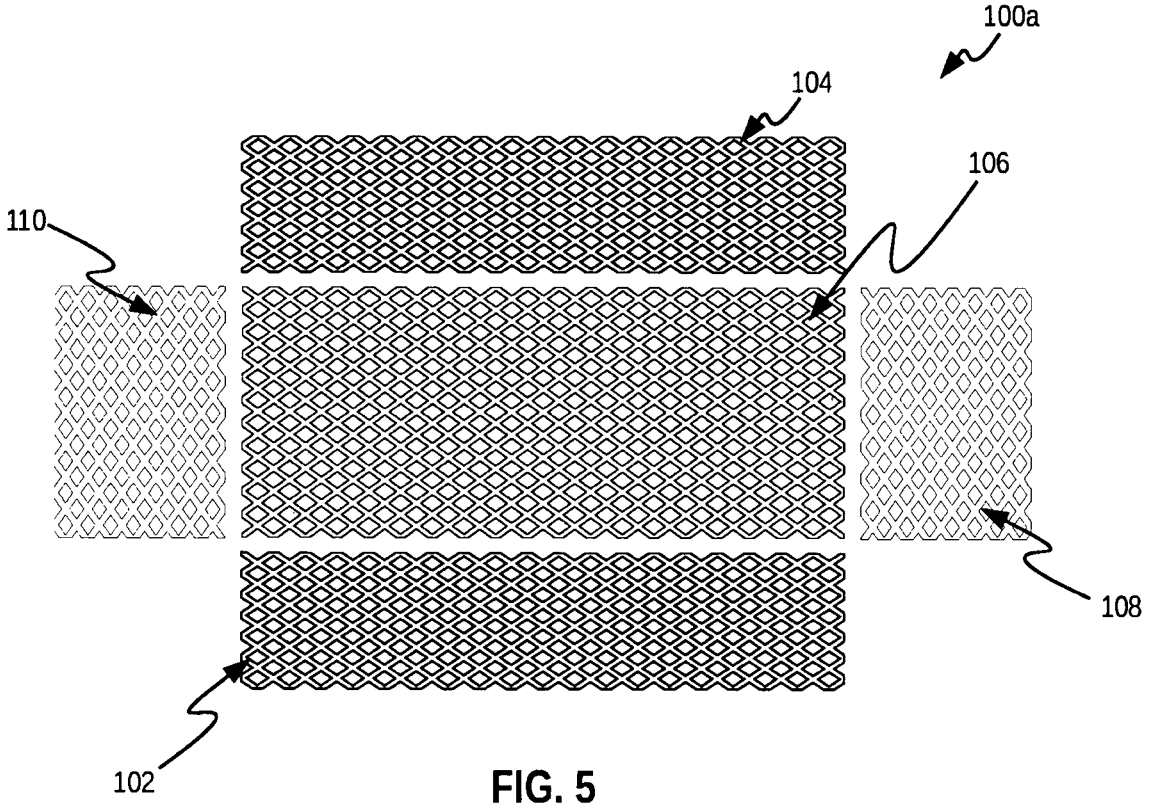
FIGS. 5-8, 11, 12, 16, and 19 are plan views of examples of sheets of material or blanks from which embodiments of the invention disclosed herein can be formed.

As seen in FIG. 5, opposed sidewalls 102, 104, top wall 106, and end walls 108, 110 of embodiments can be formed from separate pieces as illustrated in arrangement 100*a* and in embodiments can be part of a kit an end user can use to assemble guard 100. The pieces can be placed in the desired configuration and connected by welding, adhesive, mechanical fasteners, such as wire or plastic ties, or any other suitable methods. In embodiments, the pieces can be arranged with front and back sidewalls 102, 104 connected to and perpendicular to top wall 106 along longer edges of top wall 106, and first and second end walls 108, 110 connected to and perpendicular to top wall 106 along shorter edges of top wall 106.

Figure 6:
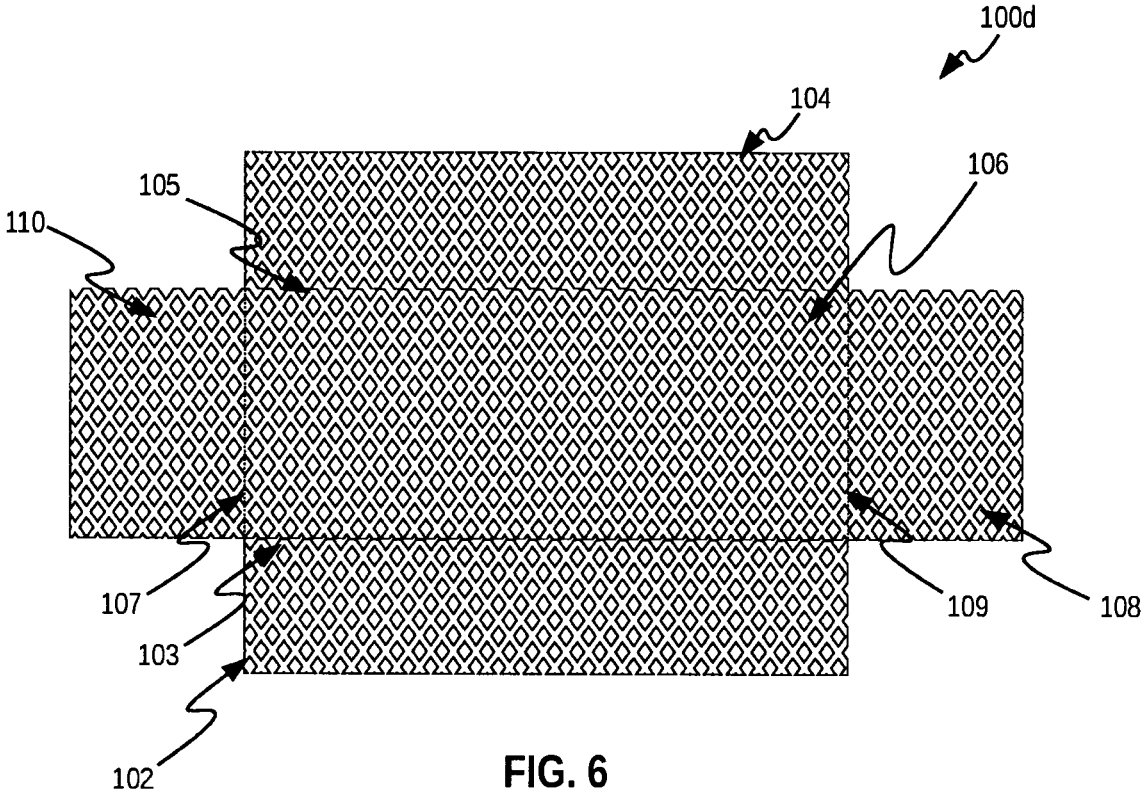

With reference to FIG. 6, other embodiments can have all walls 102, 104, 106, 108, 110 formed from a single sheet of material, illustrated as blank 100*d*. Sidewalls 102, 104 and end walls 108, 110 can subsequently be bent along fold lines 103, 105, 107, 109 to form downspout guard 100. In such embodiments, end walls 108, 110 can then be connected to sidewalls 102, 104 by welding, adhesive, mechanical fasteners, such as wire or plastic ties, or any other suitable methods. In some such embodiments, if the mesh material is stiff enough and/or heavy enough, such connections between end walls 108, 110 and sidewalls 102, 104 are optional.

Figure 7:
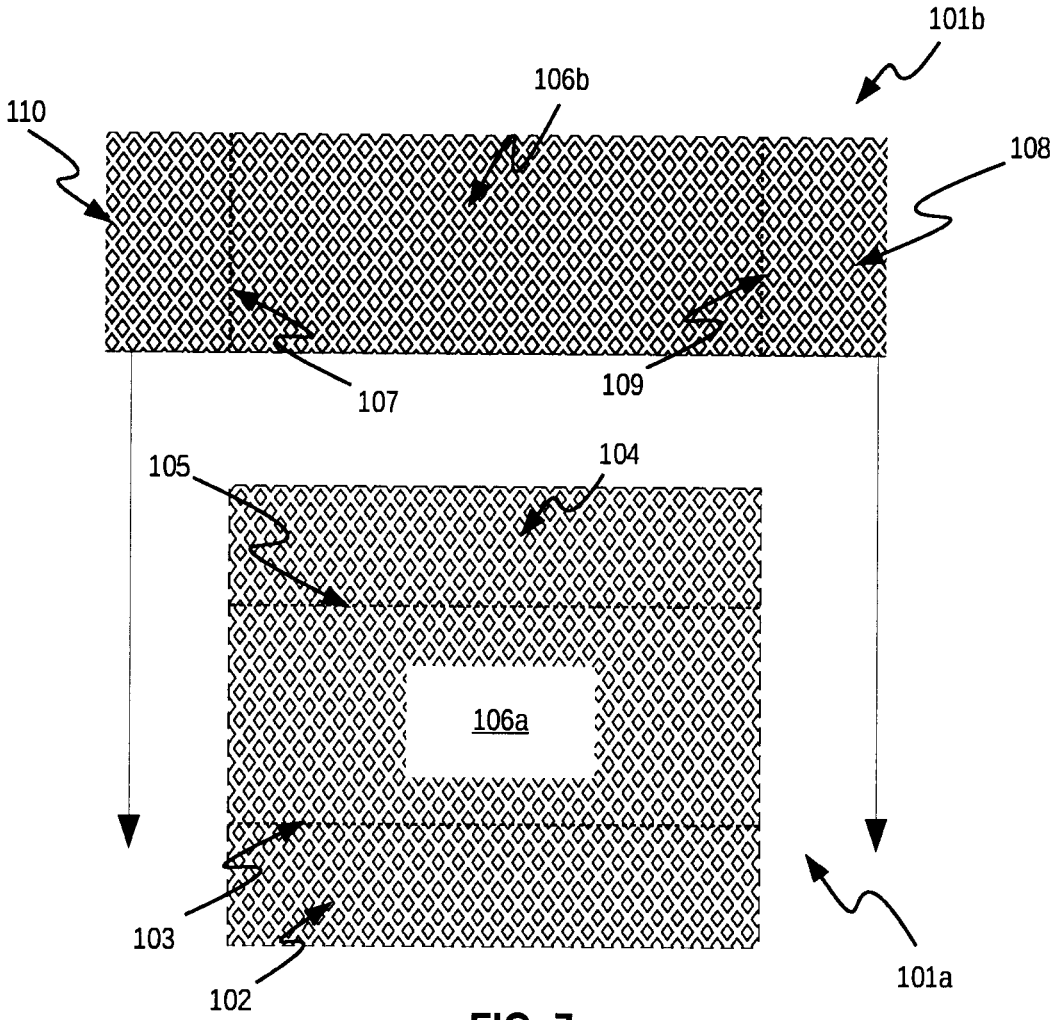
Figure 8:
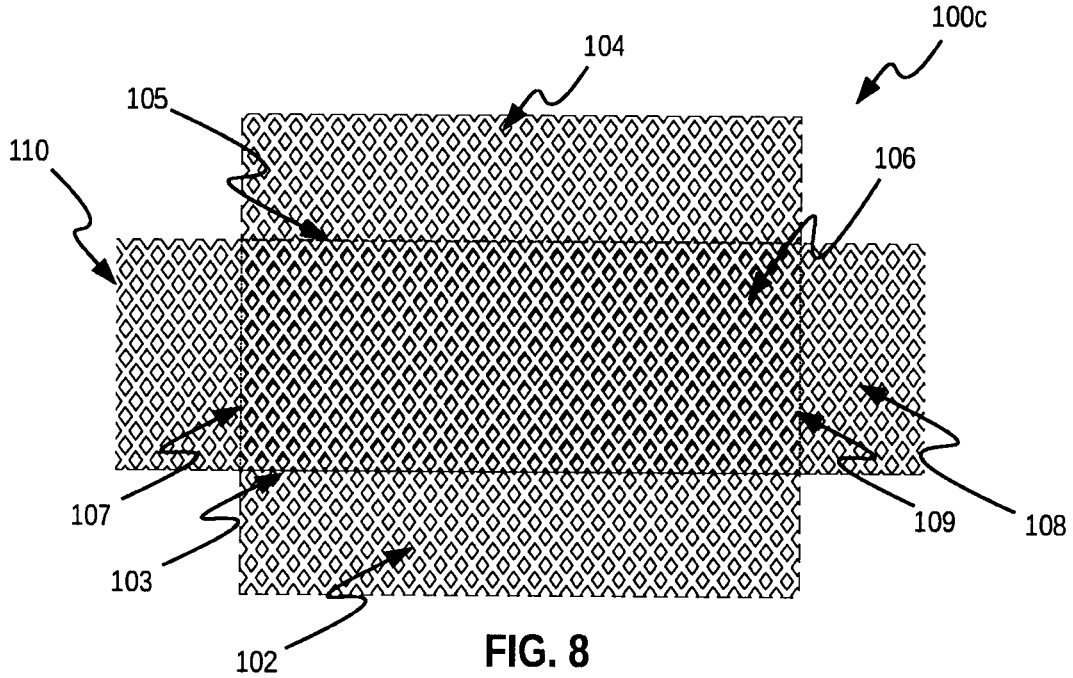

In addition, as illustrated in FIGS. 7 and 8, embodiments can have sidewalls 102, 104 and first top wall portion 106*a* formed form a first sheet of material 101*a*, while a second sheet of material 101*b* can include end walls 108, 110 and an additional top wall portion 106*b*. The two pieces of material 101*a*, 101*b* can be oriented and superimposed so that the top wall portion 106*a* of the first sheet 101*a* overlies the top wall portion 106*b* of the second sheet 101*b* or vice versa. Sidewalls 102, 104 and end walls 108, 110 can then be bent into position along fold lines fold lines 103, 105, 107, 109, and sidewalls 102, 104 can be connected to end walls 108, 110 using welding, adhesive, mechanical fasteners, such as wire or plastic ties, or any other suitable methods. In embodiments, the mesh material can be more rigid so that an end user might not be able to successfully bend parts as needed, and so the first and second sheets of material can be bent during manufacture for easy assembly by an end user.

Figure 9:
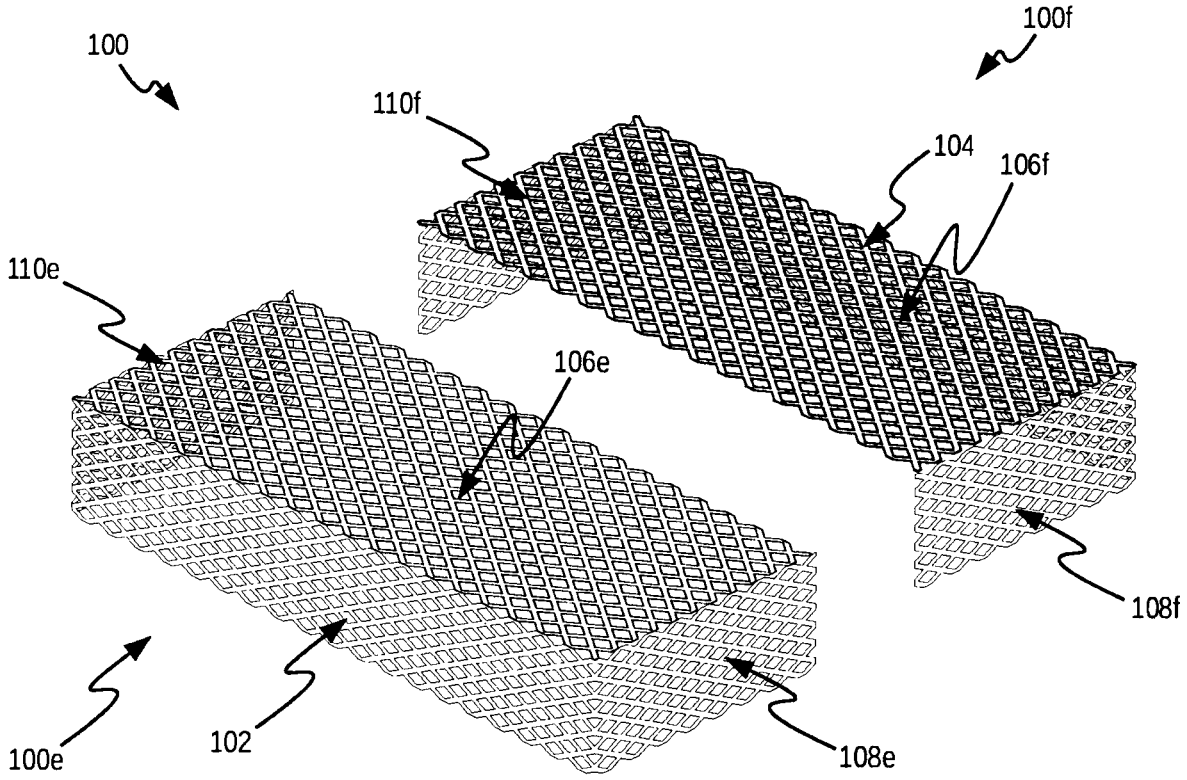
Figure 10:
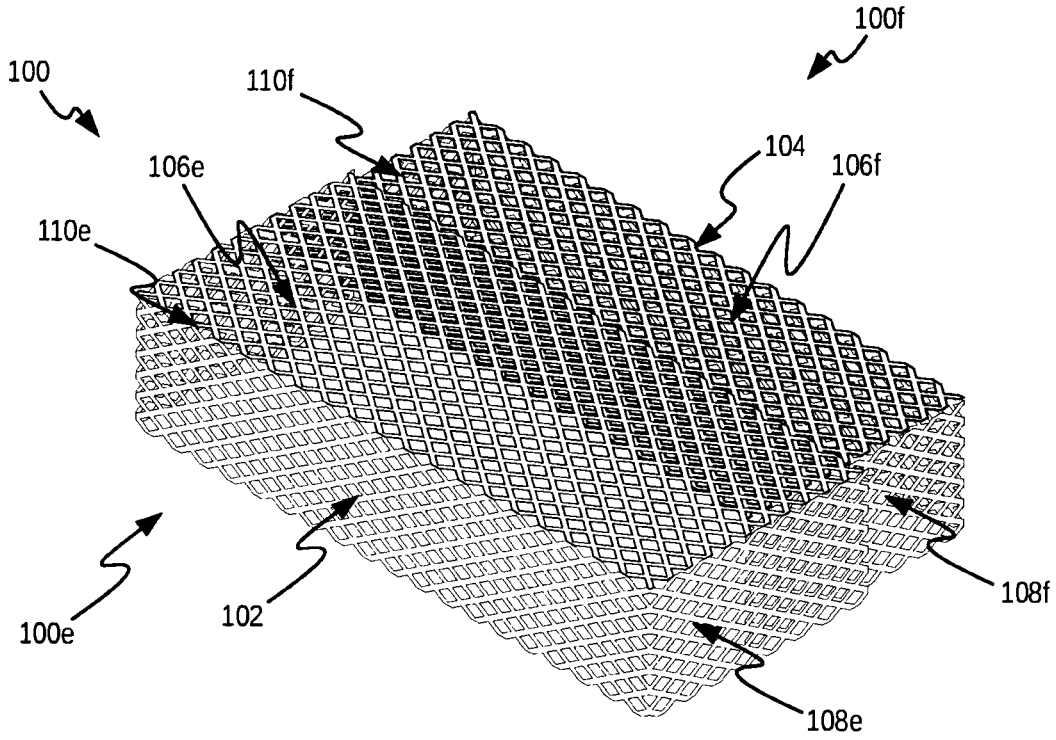
Figure 11:
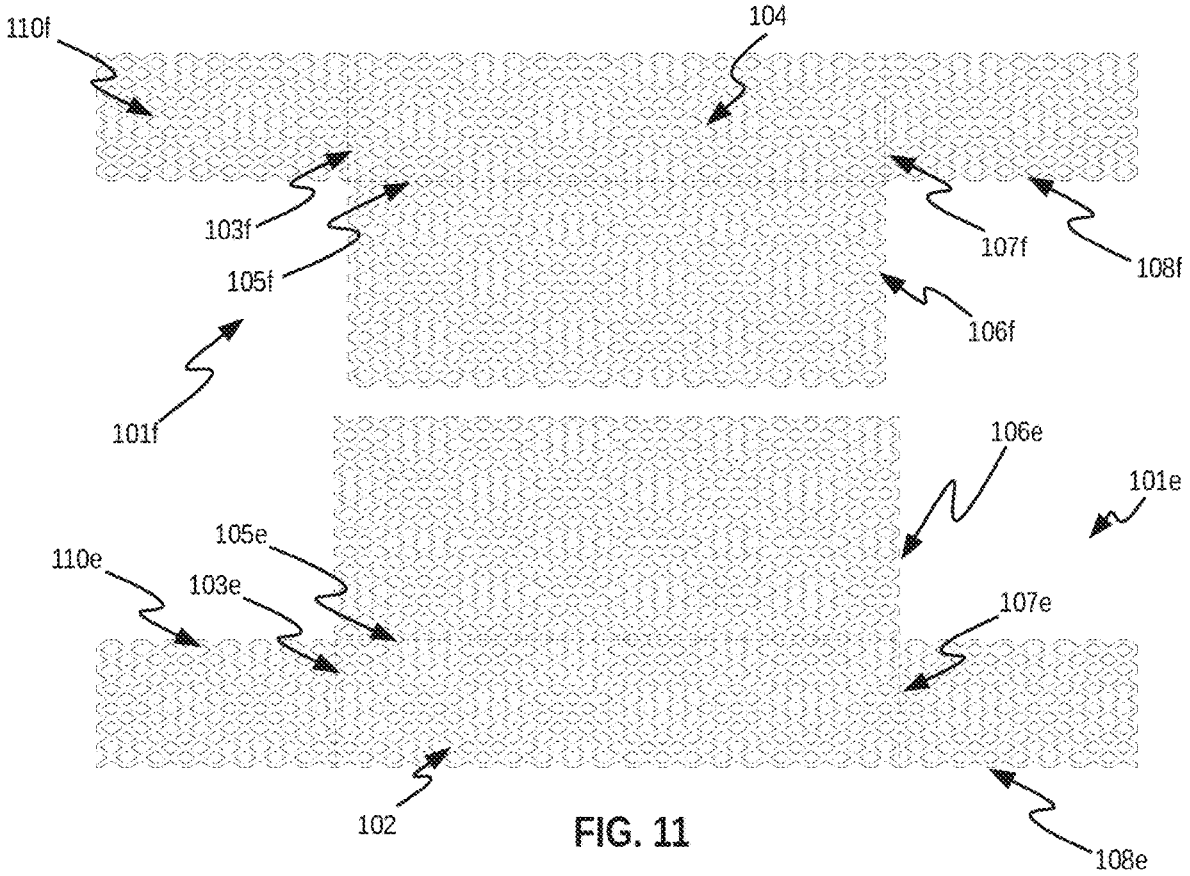

FIGS. 9-11 illustrate an example of a variable-width embodiment in which two guard portions 100*e*, 100*f* can each include respective sidewalls 102, 104, as well as portions of top wall 106 and end walls 108, 110. One of guard portions 100*e*, 100*f* in such embodiments can be slightly larger than the other so that one can be slid inside the other to achieve a desired width of guard 100. Once the desired width is achieved, guard portions 100*e*, 100*f* can be attached to each other using any suitable method, such as those used to attach walls to each other in embodiments above.

FIGS. 9-11 also illustrate an example of a method of making a variable-width guard, such as that shown in FIG. 10. As seen in FIG. 11, a variable-width guard can be formed from two sheets of material or blanks 101*e*, 101*f*. Blank 101*e* can include sidewall 102, top wall portion 106*e*, and end wall portions 108*e*, 110*e*. Similarly, blank 101*f* can include sidewall 104, top wall portion 106*f*, and end wall portions 108*f*, 110*f*. Blank 101*e* can then be folded along fold lines 103*e*, 105*e*, 107*e* to form a first portion 100*e* of guard 100, while blank 101*f* can be folded along fold lines 103*f*, 105*f*, 107*f* to form a second portion 100*f* of guard 100.

Figure 12:
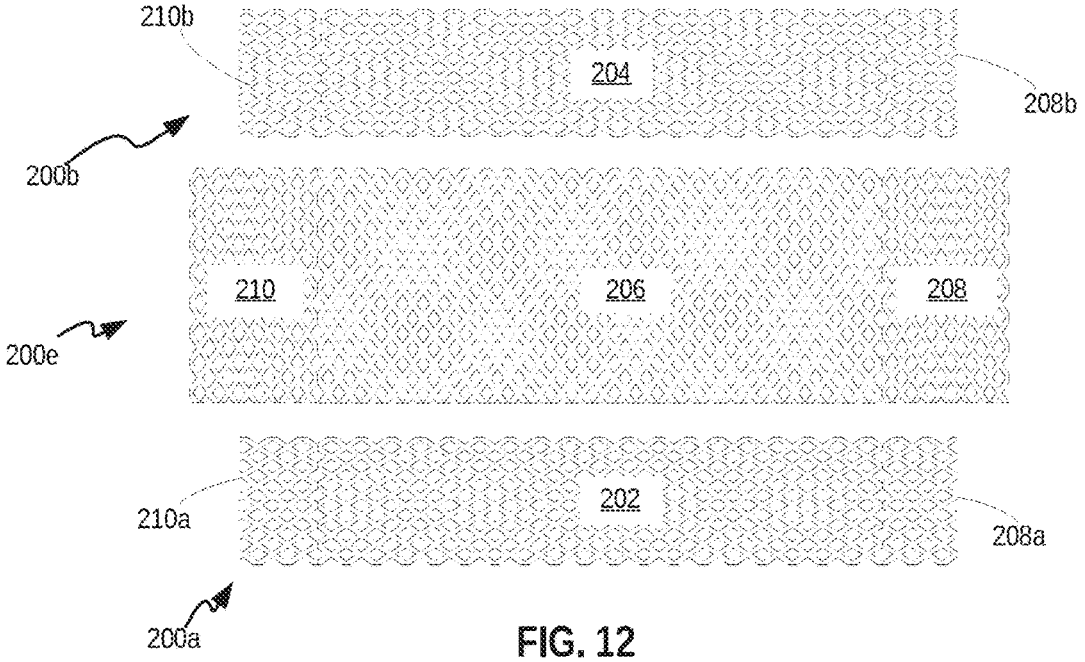
Figure 13:
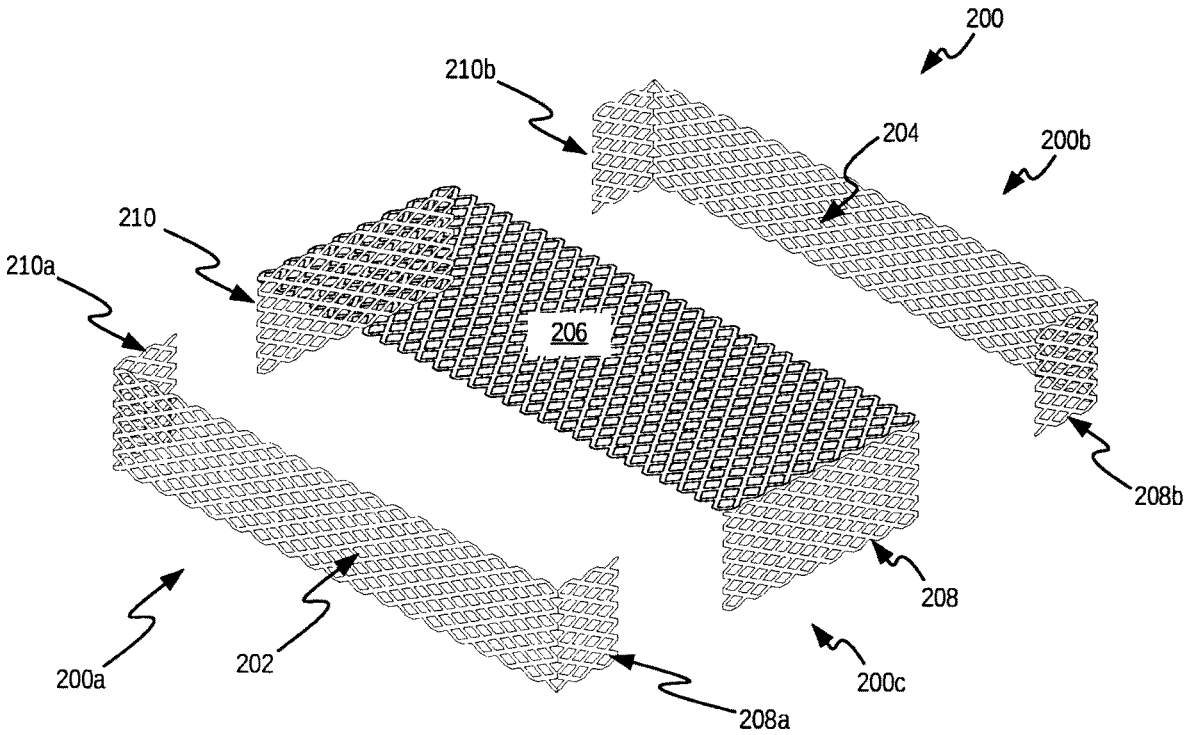
Figure 14:
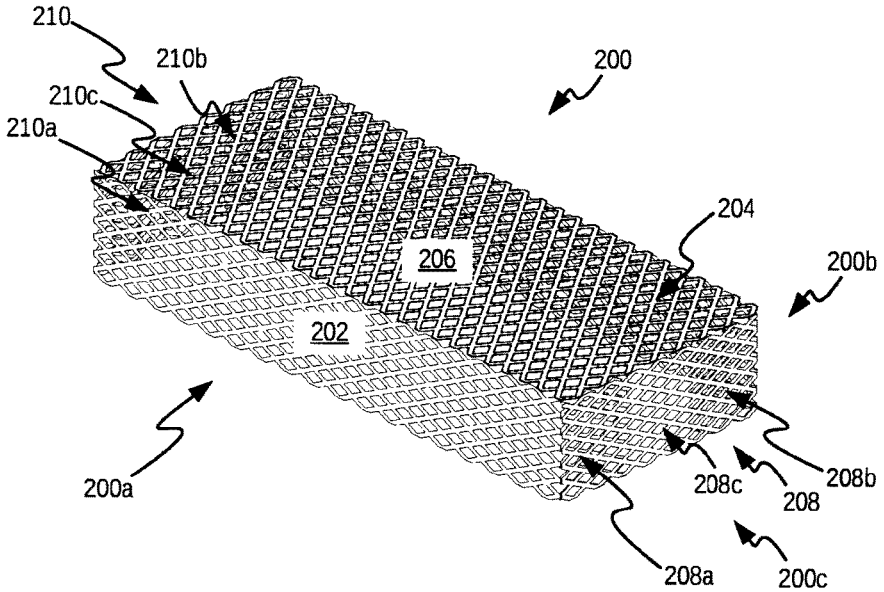

As seen in FIGS. 12-14, a guard 200 (FIG. 14) according to embodiments can have opposed sidewalls 202, 204, top wall 206, and end walls 208, 210 can be formed from three separate pieces including front sidewall piece 200*a*, back sidewall piece 200*b*, and top wall piece 200*e*. Front and back sidewall pieces 200*a*, 200*b* can each include respective front and back sidewalls 202, 204, respective first end wall tabs 208*a*, 208*b*, and respective second end wall tabs 210*a*, 210*b*. Likewise, top wall piece 200*e* can include respective top wall 206 and first and second end walls 208, 210. The pieces and/or tabs can be bent 90° and the pieces can be placed in the desired configuration and attached or connected by welding, adhesive, mechanical fasteners, such as wire or plastic ties, or any other suitable methods. In embodiments, the pieces can be arranged with front and back sidewalls 202, 204 connected to first and second end walls 208, 210 via respective end wall tabs 208*a*, 208*b*, 210*a*, 210*b*, and first and second end walls 208, 210 connected to and perpendicular to top wall 206 along shorter edges of top wall 206 via first and second end wall tabs 206*c*, 206*d*.

FIGS. 13 and 14 show an implementation of the example illustrated in FIG. 12 to form a guard 200 according to embodiments. FIG. 13 shows end walls 208, 210 bent relative to top wall 206 in preparation for assembly. Likewise, FIG. 13 shows first and second end wall tabs 208*a*, 210*a*, 208*b*, 210*b* bent relative to respective front and back sidewalls 202, 204 in preparation for assembly of guard 200. FIG. 14 shows assembled guard 200 where sidewall pieces 200*a*, 200*b* have been aligned with first end wall tabs 208*a*, 208*b* under first end wall 208 and second end wall tabs 210*a*, 210*b* under second end wall 210, and where tops of front and back sidewalls 202, 204 have been aligned with long edges of top wall 206. All that would remain to complete guard 200, substantially identical to guard 100 as seen in FIG. 2, would be to attach the aligned walls and tabs as suitable and/or appropriate. Alternatively, the walls and wall tabs can be attached during earlier parts of assembly or whenever a user deems it convenient and/or suitable and/or appropriate.

A method of assembling a downspout guard 200 according to embodiments can therefore include providing at least three pieces of mesh material, which can include providing a first piece of mesh material including top wall 206, providing a second piece of mesh material 200*a* including front sidewall 202, and providing a third piece of mesh material 200*b* including back sidewall 204. In embodiments, the first piece of mesh material 200*e* can include first end wall 208 and second 210, while in other embodiments, the first piece of mesh material can include just top wall 206. Additionally, embodiments can include providing first and second end wall tabs 208*a*, 210*a*, 208*b*, 210*b* on each of second and third pieces of mesh material 200*a*, 200*b*. Where the first piece of mesh material includes only top wall 206, the method can further include providing fourth and fifth pieces of mesh material 200*c*, 200*d*, which can include first and second end walls 208, 210, respectively, and respective top wall tabs 206*c*, 206*d*.

In embodiments where the first piece of mesh material includes first and second end walls 208, 210, the method can include bending first and second end walls 208, 210 relative to top wall 206. Bending can include forming a squared-off U-shape with first and second end walls 208, 210 forming the legs of the shape. Bending can also include bending each of the first and second end walls 208, 210 so that each is substantially perpendicular to top wall 206.

Figure 15:
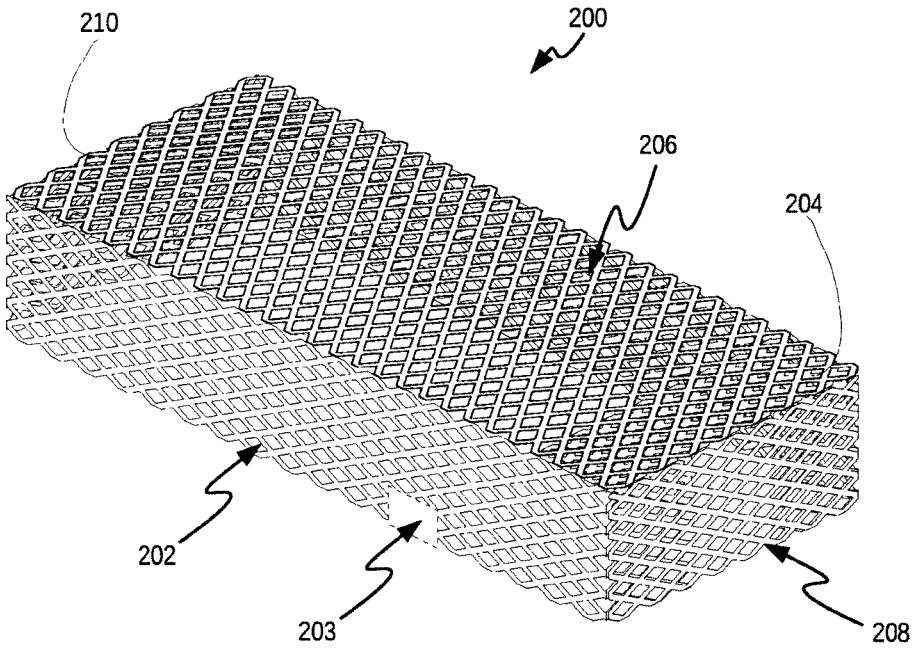
Figure 16:
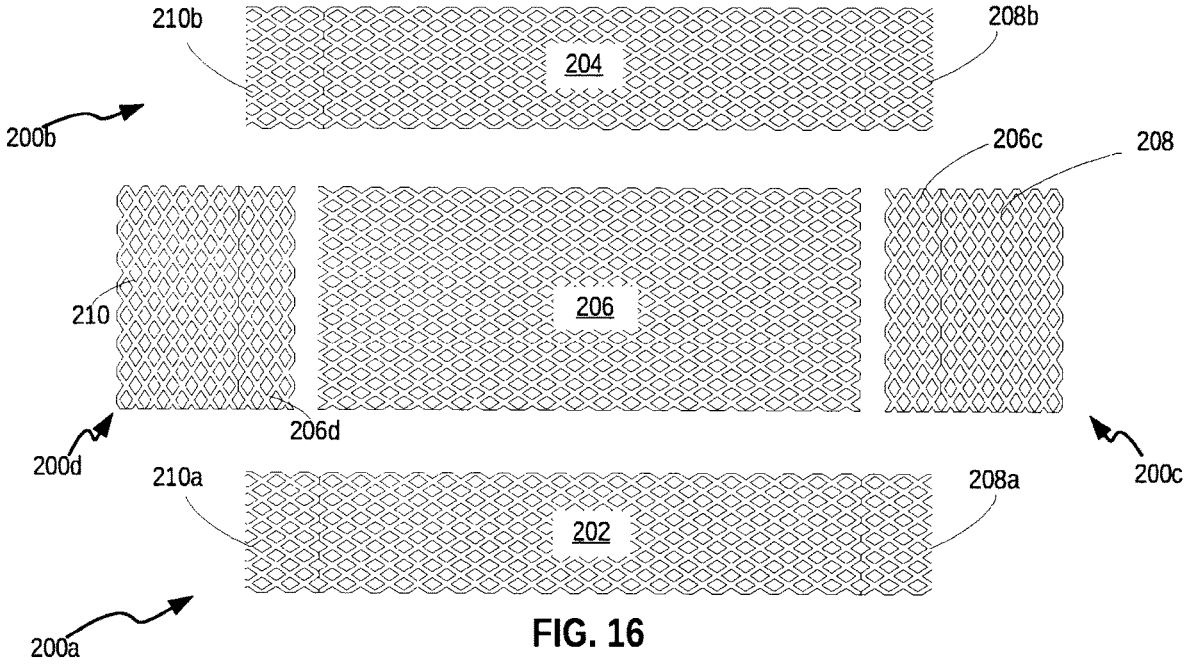
Figure 17:
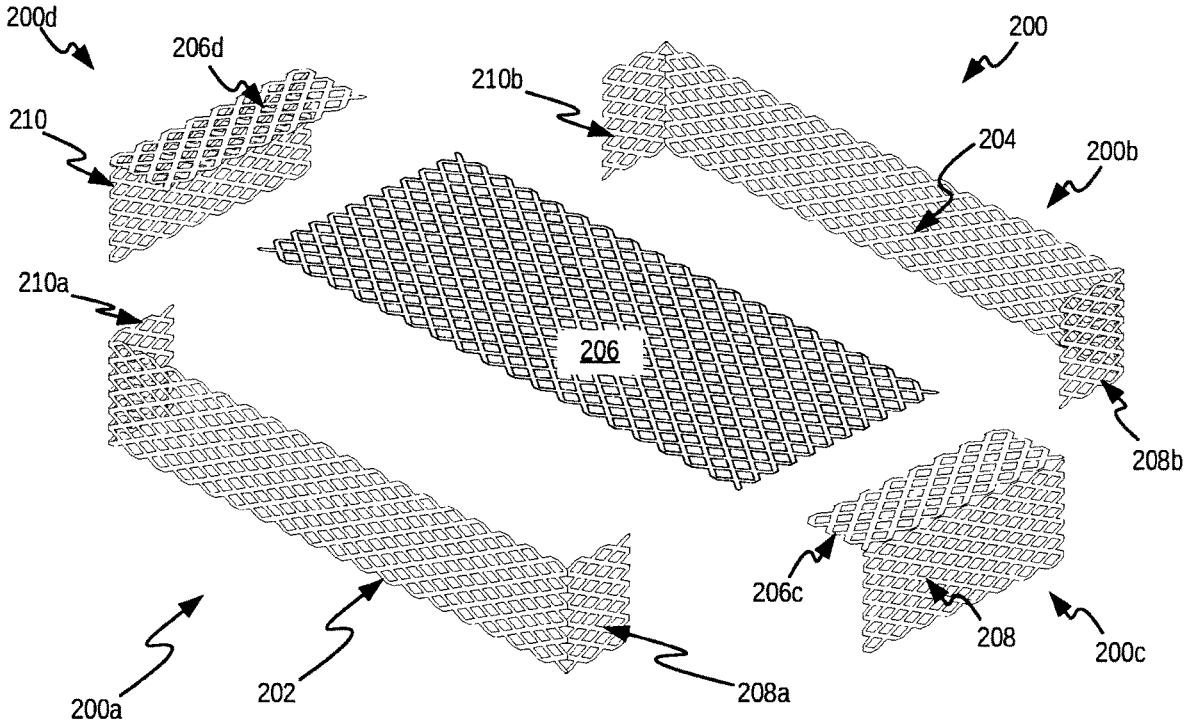
Figure 18:
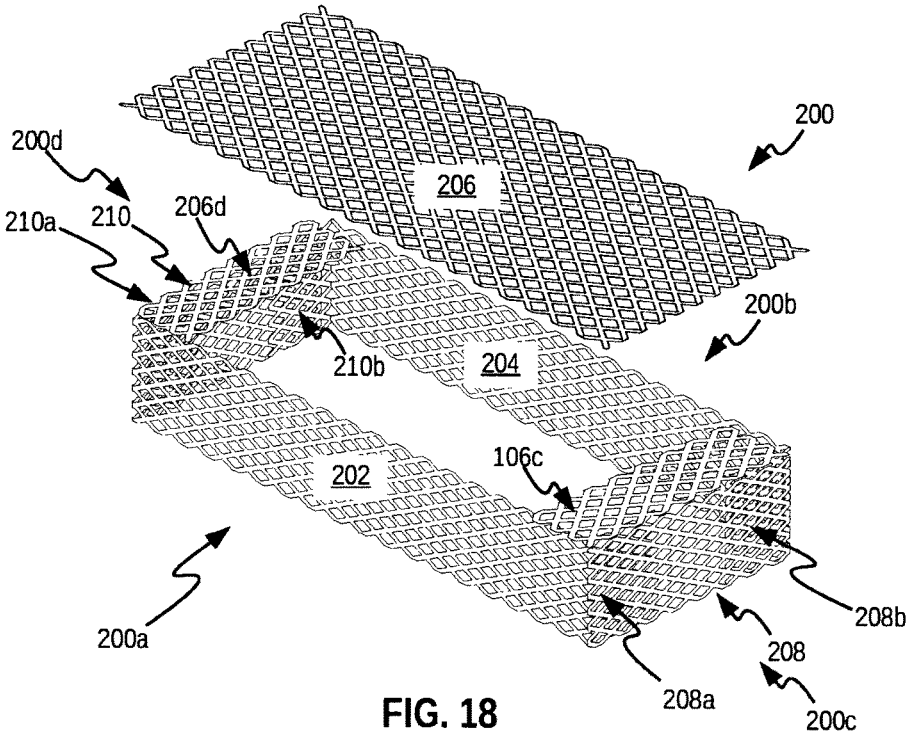
Figure 19:
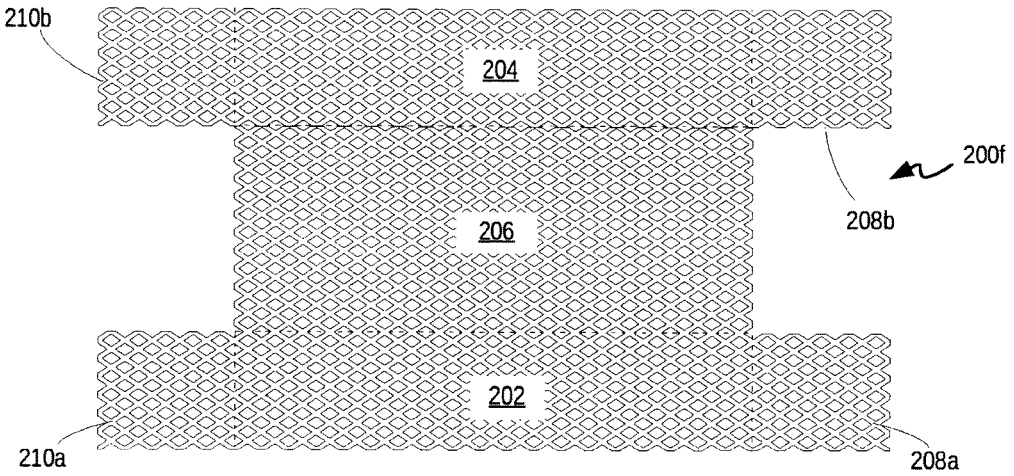
Figure 20:
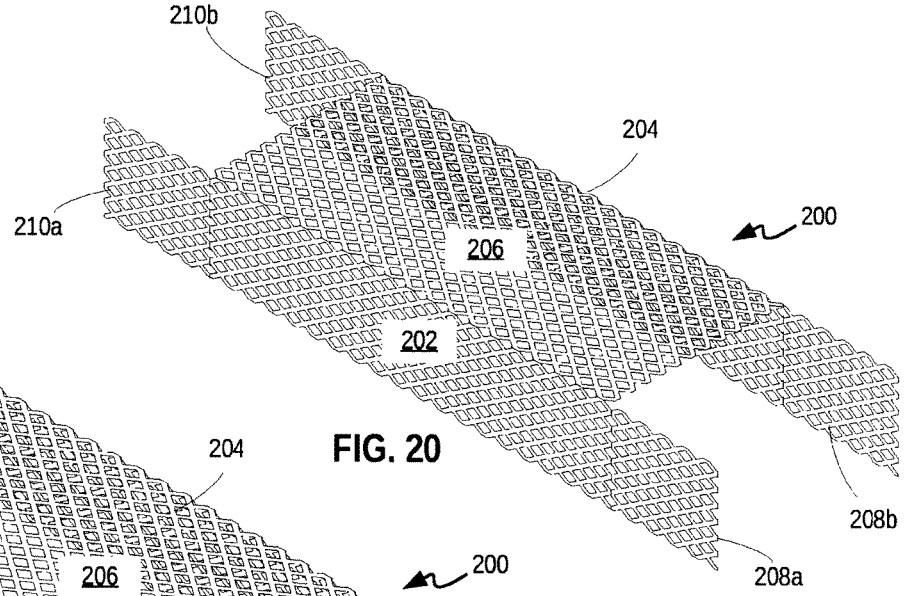
Figure 21:
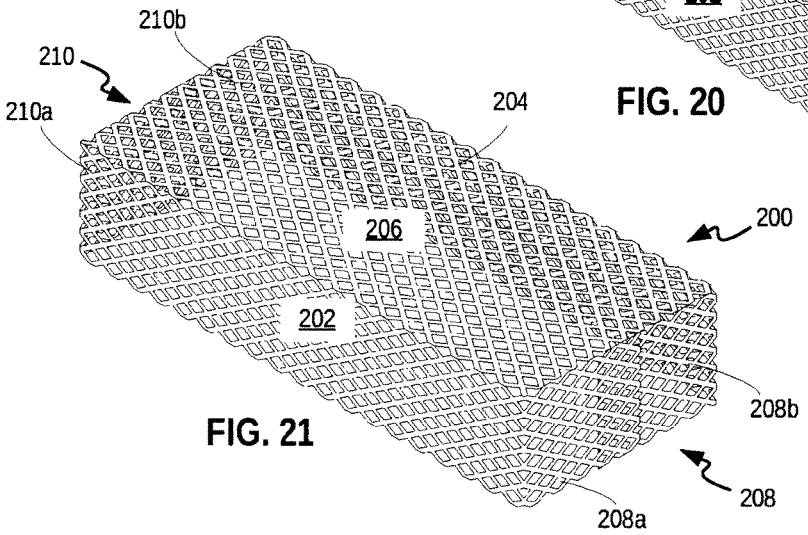

FIGS. 15-18 illustrate an embodiment in which a guard 200 can be formed from five pieces of mesh material 200*a-d*. Top wall 206 is the first piece of mesh material, and second and third pieces of mesh material 200*a*, 200*b* include respective ones of sidewalls 202, 204 and respective pairs of end wall tabs 208*a*, 210*a*, 208*b*, 210*b*. Fourth and fifth pieces of material 200*c*, 200*d* can each include respective ones of end walls 208, 210, as well as respective top wall tab portions 206*c*, 206*d*.

Where the first piece of mesh material includes only top wall 206 as illustrated in FIGS. 15-18, the method described with regard to the embodiment shown in FIGS. 12-14 can further include providing fourth and fifth pieces of mesh material 200*c*, 200*d* that can include first and second end walls 208, 210, respectively, as described above and much like the example of embodiments shown in FIG. 5. Here, however, the fourth and fifth pieces of mesh material can also include respective top wall tabs 206*c*, 206*d* that can be used to attach first and second end walls 208, 210 to top wall 206, similar to pieces 200*a*, 200*b* of FIGS. 10-12 including side walls 202, 204 and end wall tabs 208*a*, 208*b*, 210*a*, 210*b*. This is illustrated in FIGS. 17 and 18, where top wall tabs 206*c*, 206*d* are bent relative to end walls 208, 210 and end wall tabs 208*a*, 210*a*, 208*b*, 210*b* are bent relative to respective sidewalls 202, 204, then the pieces are aligned and attached to form guard 200 (FIG. 15).

In embodiments where the first piece of mesh material includes only top wall 206, the method can include bending first and second end wall tabs 208*a*, 210*a* of second piece of mesh material 200*a* relative to front sidewall 202, and bending the first and second end wall tabs 208*b*, 210*b* of third piece of mesh material 200*b*. In embodiments, bending each tab can include bending each tab to be substantially perpendicular to its respective end wall. The method can additionally include bending first top wall tab of the fourth piece of mesh material relative to first end wall 208, such as to have the two be substantially perpendicular to each other. Likewise, the method can include bending second top wall tab of the fifth piece of mesh material relative to second end wall 210, such as to have the two be substantially perpendicular to each other.

Another embodiment of guard 200 is shown in FIGS. 15-17 in which a single piece of mesh material 200*f* includes top wall 206, sidewalls 202, 204, and opposed end wall tabs 208*a*, 208*b*, 210*a*, 210*b*. As shown, the piece of mesh material 200*f* can be bent to place front and back sidewalls 202, 204 in opposition to each other and to arrange the end wall tabs for assembly. End portions of opposed end wall tabs 208*a*, 208*b* can be superimposed and attached to each other and can also be attached to top wall 206. Likewise, end portions of opposed end wall tabs 210*a*, 210*b* can be superimposed and attached to each other and can also be attached to top wall 206.

Figure 22:
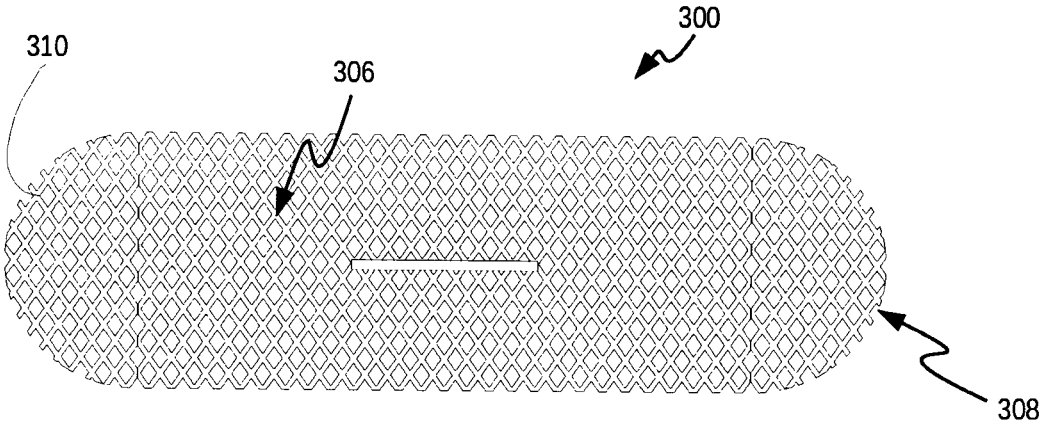
Figure 23:
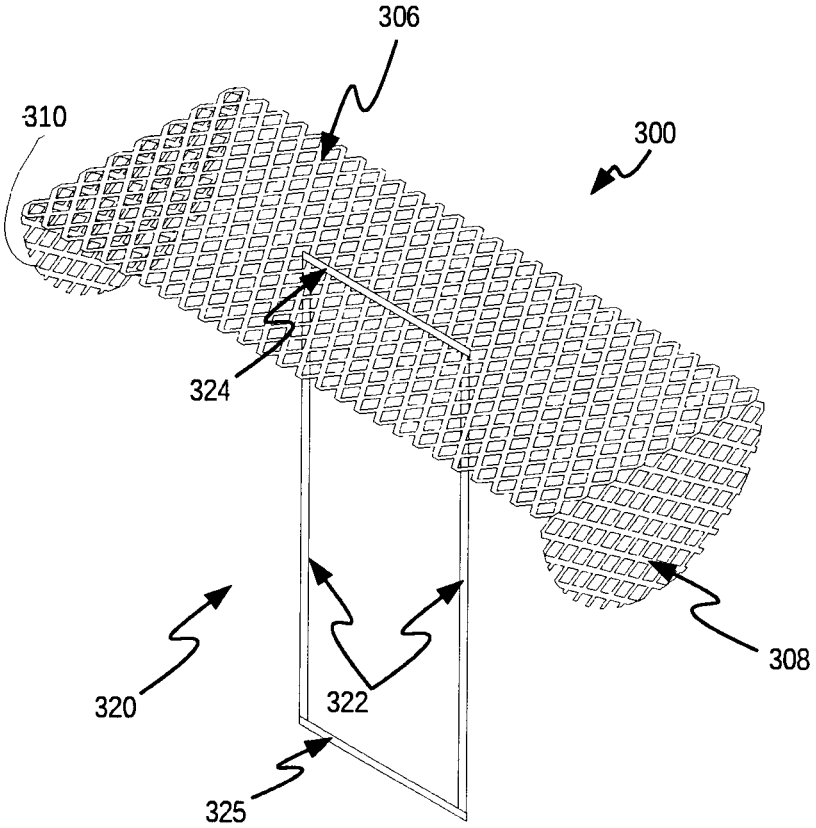

A further embodiment illustrated in FIGS. 22 and 23 shows a guard 300 suitable for use in gutters having rounded profiles or cross-sections. A piece of mesh material 300*a* includes a top wall 306 of the guard and two opposed end walls 308, 310 shaped to conform to a gutter wall, such as that of a "half-round" gutter. In such gutters, it is difficult to form the snug fit employed in most examples described herein, so a retainer 320 can be used to hold guard 300 in position. Retainer 320 can include legs 322 extending through top wall 306 and connected by connecting portion 324 resting on top wall 306. Alternatively, other retainers can be employed, such as an inverted version of retainer 320 with the ends of legs 322 attached to top wall 206, a wire or the like attached to a gutter hanger of the gutter in which guard 300 is installed, two or more pins, or other suitable insert or retainer as may be desired. It should also be noted that such retainers can be used with any embodiment of the downspout guard disclosed herein. Various illustrations of retainers that could be used are shown in FIGS. 29-33. While the guard shown therein may differ, the variations of retainer 120 can be used to secure guard 300 by insertion into downspout 20 (FIG. 29), insertion into a folded top edge of gutter 10 (FIG. 30), or by engaging a gutter hanger 17, among other variations. Such retainers can be made from metal wire, plastic, or any other suitable material.

In embodiments, a downspout guard kit can be provided that can include the pieces of mesh material and instructions for assembling downspout guard 100, 200, 300 therefrom, such as according to the method of assembly described above. In some embodiments, the required bending of portions of the pieces of mesh material can be performed prior to shipping the kit, the kit thus including pre-bent pieces of material. In some other embodiments, the pieces of mesh material in the kit can be flat, and the instructions can include bending steps, such as those described with regard to method of assembly discussed above.

Figure 24:
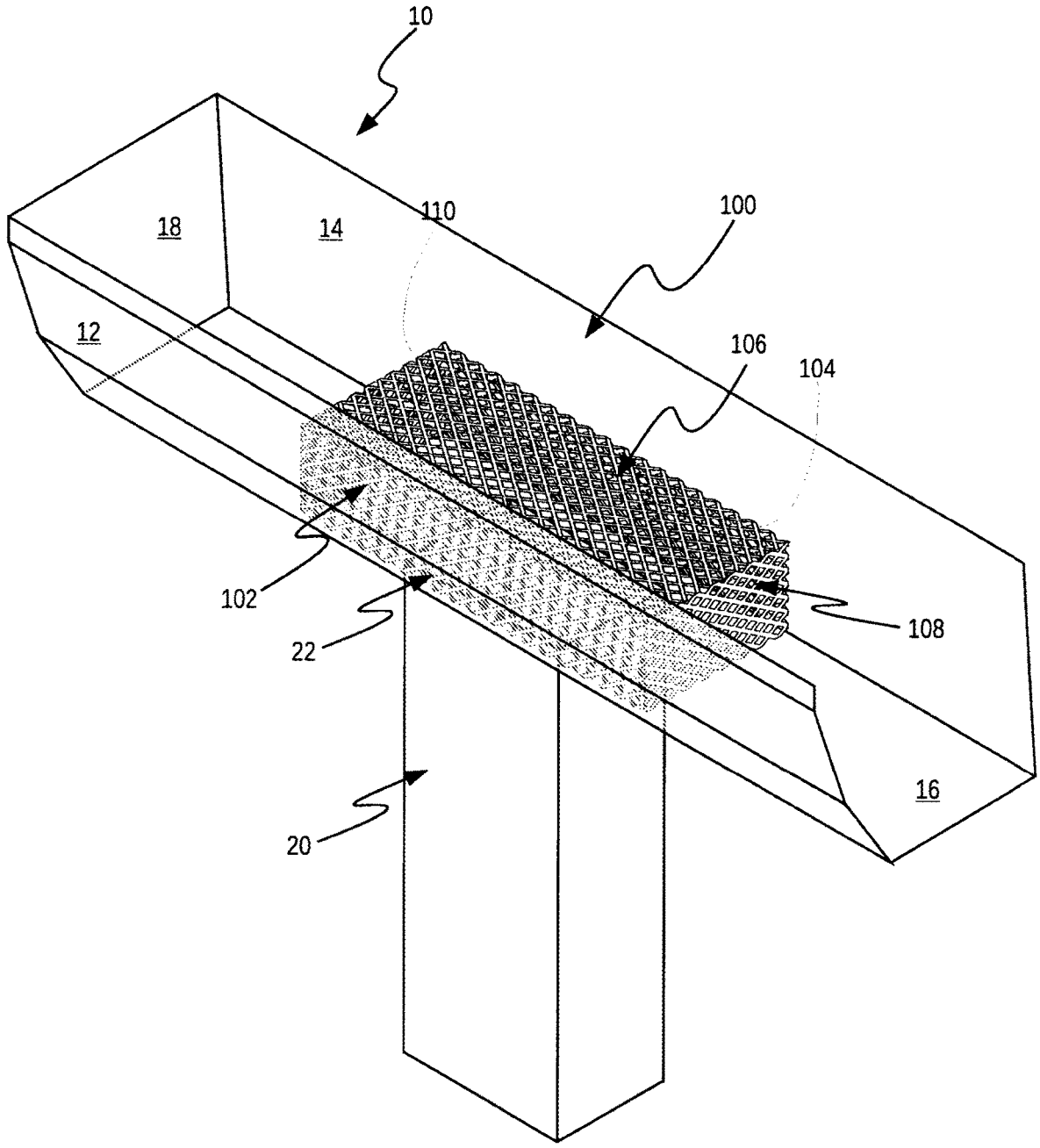
Figure 25:
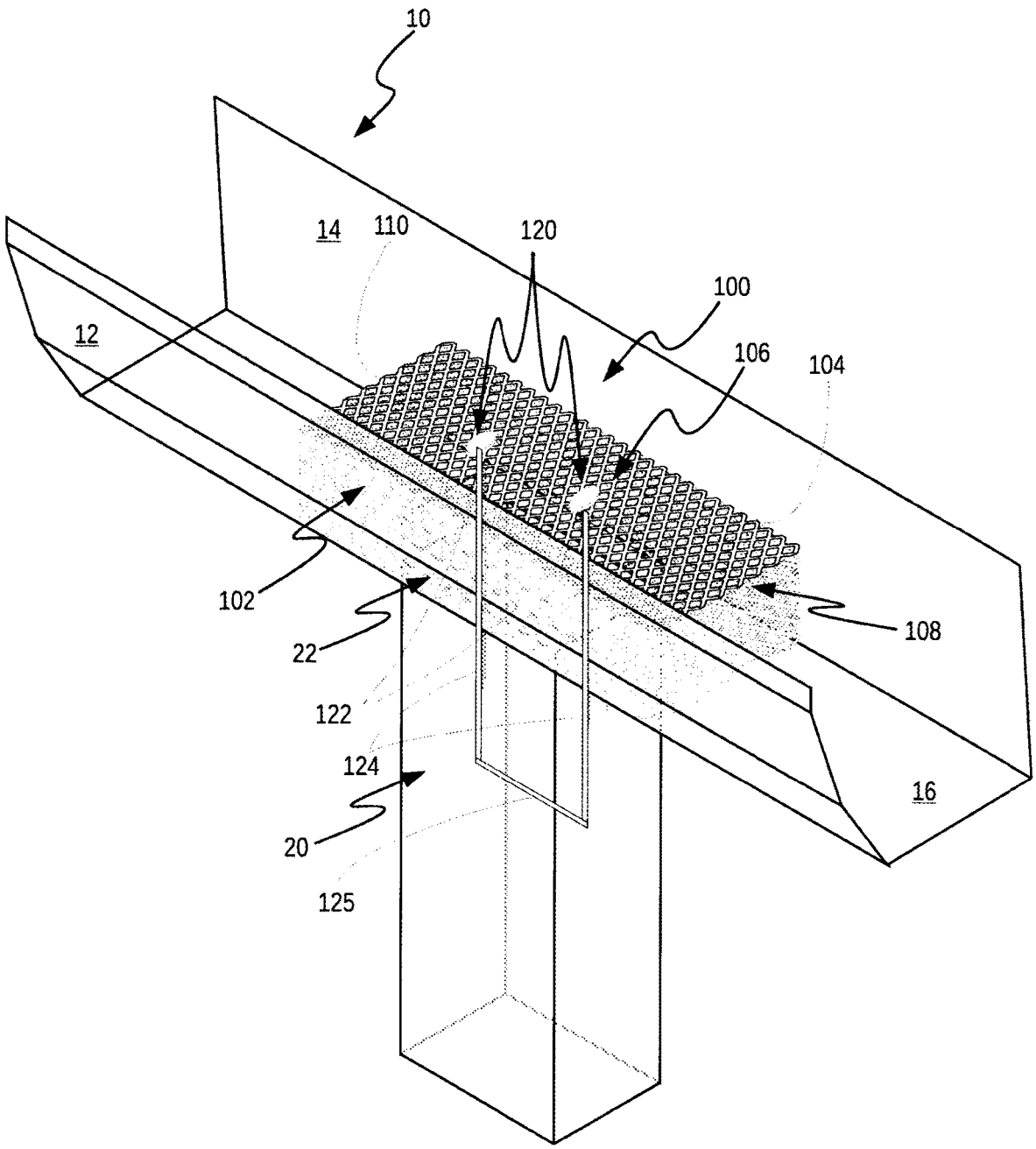
Figure 26:
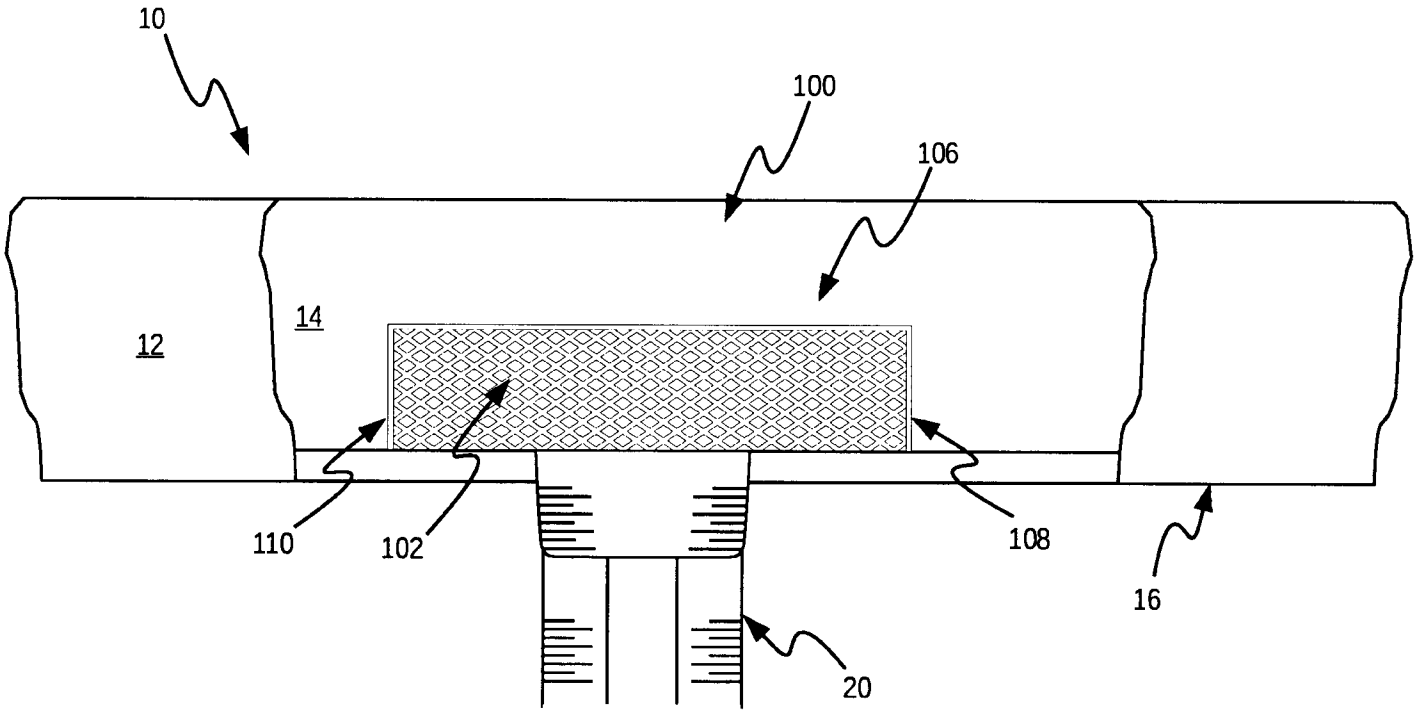

Turning to FIGS. 24-26, examples of embodiments of the inventive downspout guard 100 are shown installed in a roof gutter 10 that includes a front wall 12, back wall 14, bottom wall 16, and end wall 18. A downspout 20 is attached to roof gutter 10, which includes downspout opening 22 in bottom wall 16 to allow passage of water into downspout 20. As shown, downspout guard 100 is preferably centered over downspout opening 22 with bottom edges of opposed sidewalls 102, 104 and opposed end walls 108, 110 resting on bottom wall 16. Preferably, opposed sidewalls 102, 104 at least partially engage respective front and back walls 12, 14. However, while it is preferred that sidewalls 102, 104 engage gutter front and back walls 12, 14, guard 100 is still effective with gaps therebetween of up to about ¼" and will remain substantially in position in even heavy flow through gutter 10. Because guard 100 does not rely on any downspout insert, downspout opening 22 can be round, oval, or rectangular shape. Guard 100 in embodiments is sized to more than cover any such shape downspout opening 22 may have. Preferably, for example, top wall 106 can have an area of at least twice the area of an opening of downspout opening 20. It should be understood that while guard 100 is shown in FIGS. 24-26, guard 200 contemplated in FIGS.

12-21 according to embodiments and guard 300 contemplated in FIGS. 22 and 23 according to embodiments can be substituted therefor.

To resist movement of downspout guard 100 from its position in roof gutter 10, a width of top wall 106 and opposed end walls 108, 110 is preferably selected so that opposed sidewalls 102, 104 provide an interference fit, or at least a snug fit, with front and back walls 12, 14 of roof gutter 10. This can be facilitated by forming the walls of downspout guard 100 from a mesh material, such as a metal mesh material, though a plastic mesh material could also be used. Metal mesh material is preferred since it is typically sturdier, heavier (and thus more resistant to being dislodged by water and/or debris), and has a reduced risk of failure due to solarization as would be likely to occur with plastic mesh material. In experiments, a powder coated metal mesh material was found to be very effective, particularly powder coated expanded metal mesh material. Preferably, the mesh material of at least opposed end walls 108, 110 has a diamond pattern relative to a plane of top wall 106 of downspout guard 100, and preferably the diamond pattern is oriented such that a long axis of each diamond of the pattern is parallel to the plane of top wall 106. Experiments were performed with a mesh having a SWD of no more than 0.25", a LWD of no more than 0.40", and a ratio of open area of at least from 60% to 65%, which performed well. While mesh having these characteristics is preferred, it is expected that variations in size would still be effective.

In embodiments, where additional positional security of guard 100 is desired, such as when the preferred snug or slight interference fit cannot be achieved, a retainer in the form of connected pins 120 shown in FIG. 25 can be inserted through top wall 106 so as to extend through downspout opening 22 into downspout 20. Each pin 120 can include a head 122 sized to rest on top wall 106, as well as a shaft 124 sized to fit through the mesh openings of top wall 106 and into downspout 20. While head 122 is shown, it should be noted that a hook or other means for preventing travel of shaft 124 and pin 210 as a whole can be used. Where two or more pins 120 are used, shafts 124 can be connected by a transverse member 125 at bottoms of shafts 124, forming a U-shape. While two pins 120 are shown, it should be understood that more or fewer pins 120 can be used as desired, suitable, and/or needed. Alternatively, as seen in FIGS. 22 and 23 with regard to an alternative embodiment guard 300 for gutters with rounded profiles, a U-shaped retainer 320 can be used. Retainer 320 can be formed from a piece of wire or the like 320 fashioned into a U shape so that legs 322 of the U can be inserted through top wall 306 of guard 300, such as about halfway between opposed end walls 308, 210, with connecting portion 324 resting on top wall 306. While one retainer 320 is shown, it should be understood that fewer or more retainers 320 could be used as desired, suitable, and/or needed. To provide additional rigidity of retainer 320, a second connection portion 325 can be included. It should further be understood that other retainers could be employed, such as an inverted version of retainer 320 with the ends of legs 322 attached to top wall 106, a wire or the like attached to a gutter hanger of the gutter in which guard 100 is installed, two or more pins, or other suitable insert as may be desired. Additional illustrations of retainers that could be used are shown in FIGS. 29-33. As seen in the FIGS., variations of retainer 120 can be used to secure guard 100, 200, 300 by insertion into downspout 20 (FIG. 29), insertion into a folded top edge of gutter 10 (FIG. 30), or by engaging a gutter hanger 17, among other variations. It should also be noted that such retainers can be used with any embodiment of the downspout guard disclosed herein.

Figure 27:
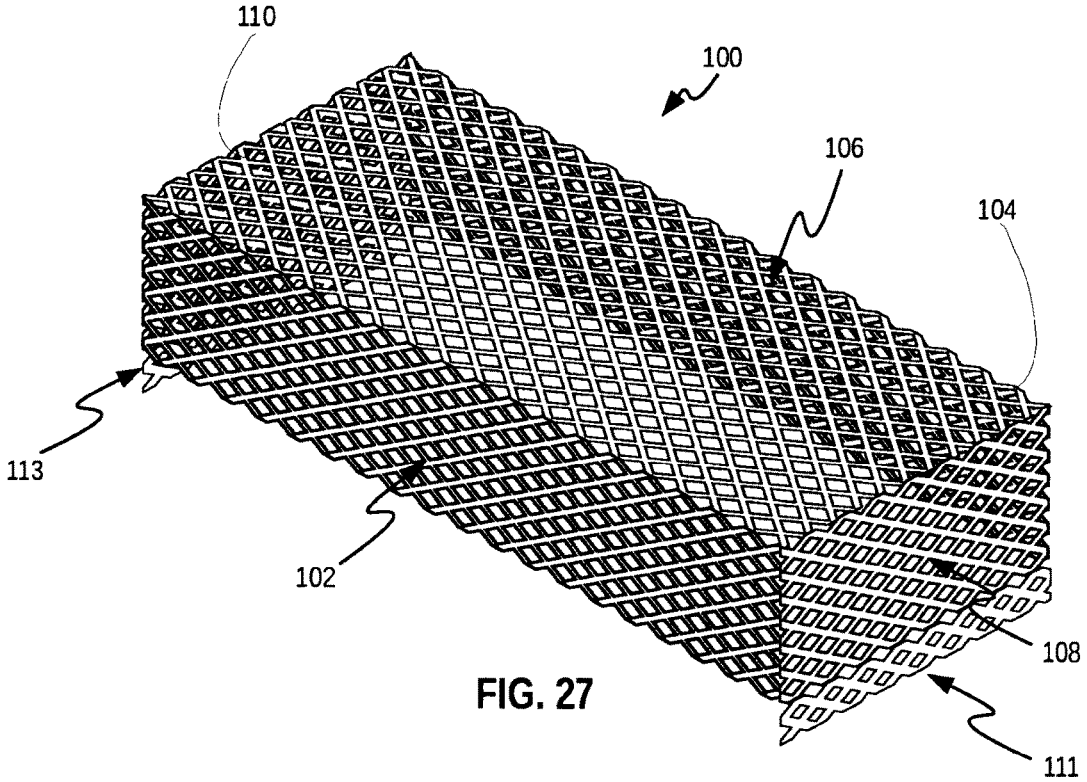
Figure 28:
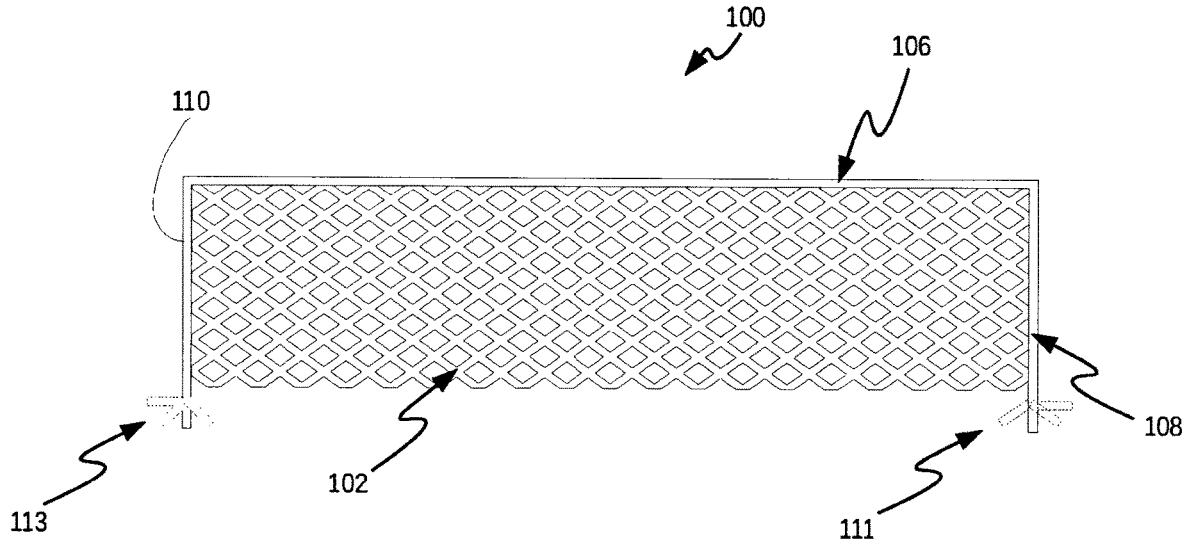
Figure 29:
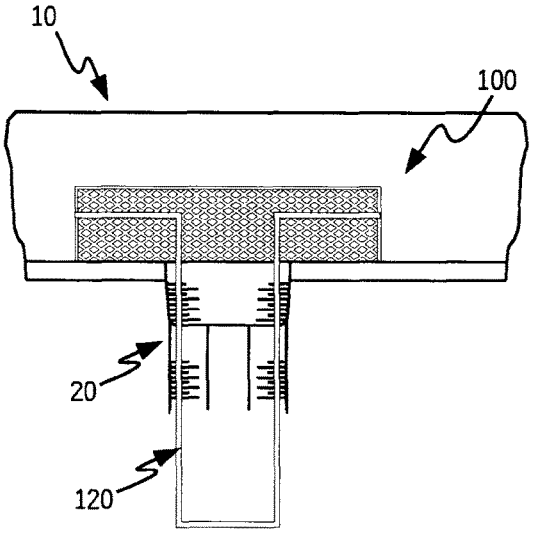
FIGS. 29-33 are side views of an implementation of a downspout guard according to embodiments disclosed herein and illustrating a variety of retainers that can be used therewith, also according to embodiments disclosed herein.
Figure 30:
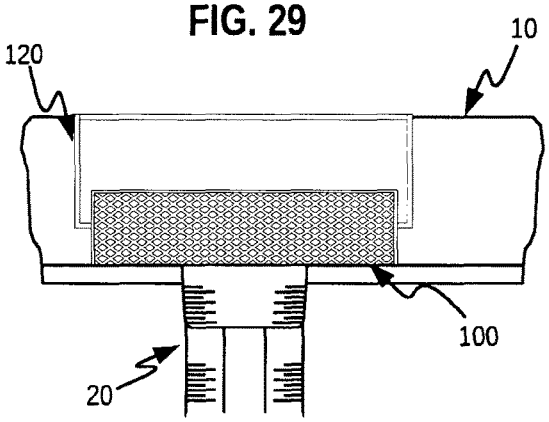
Figure 33:
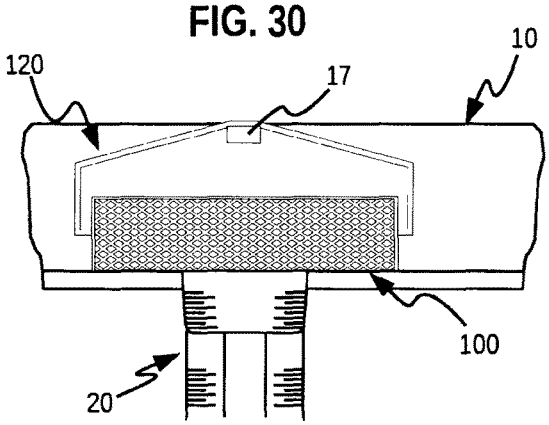
Figure 31:
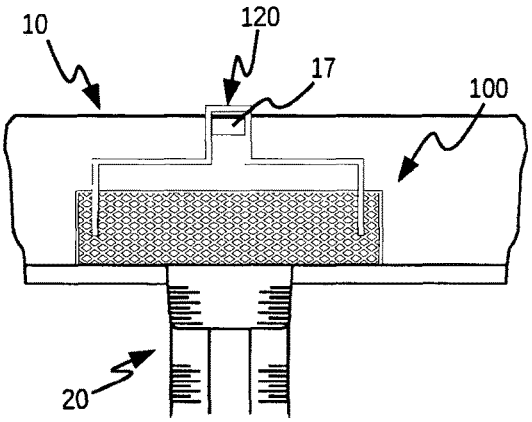
Figure 32:
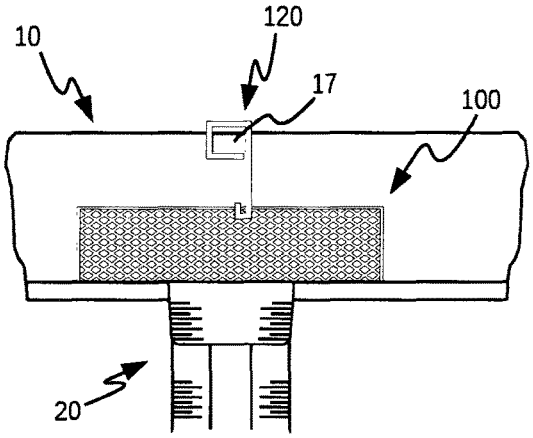
Figure 34:
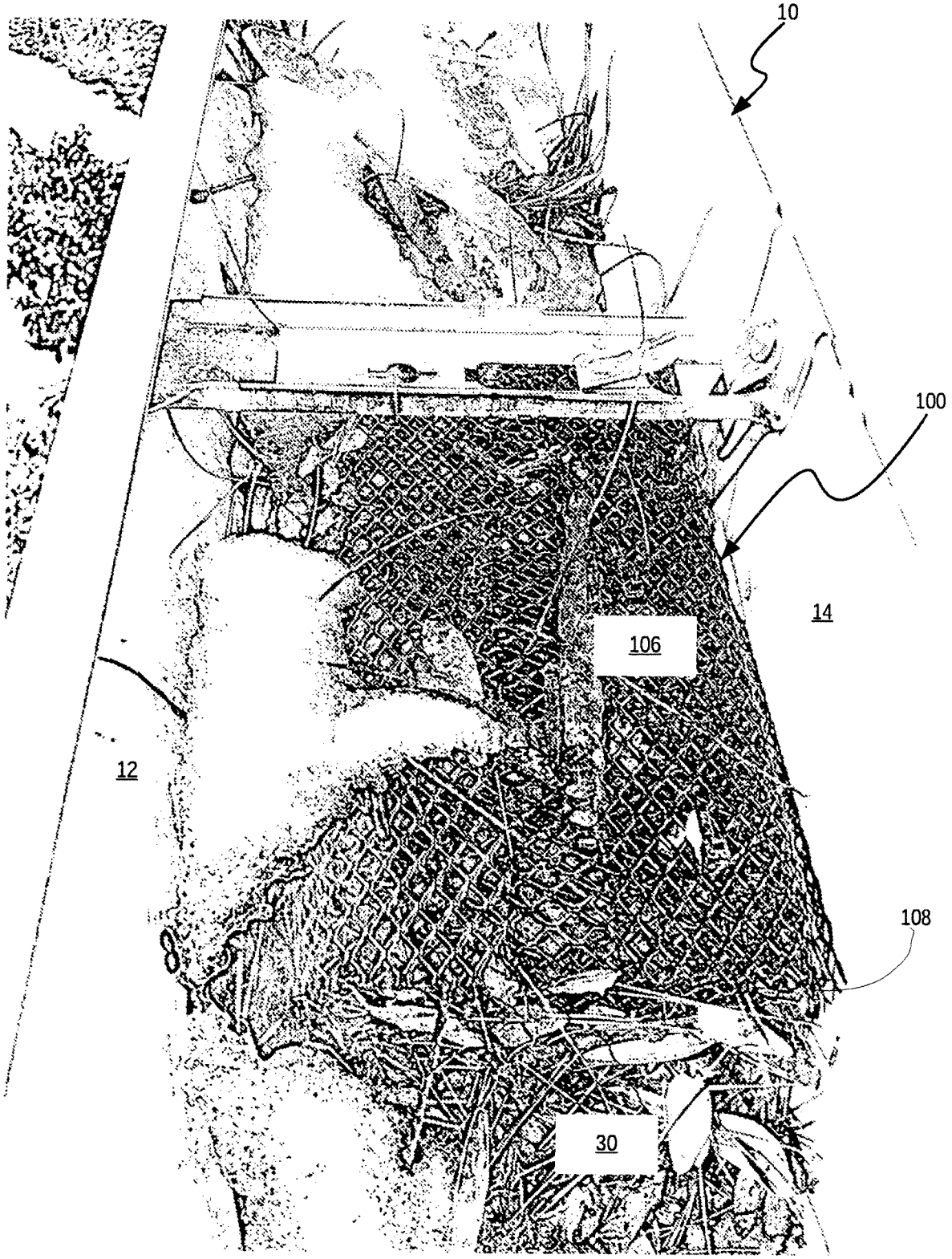
FIG. 34 is an illustration of an example of a downspout guard according to embodiments of the invention disclosed herein in use.

Embodiments of downspout guard 100 as shown in FIGS. 27 and 28 can have opposed end walls 108, 110 taller than opposed sidewalls 102, 104. In FIGS. 27 and 28, end wall extensions 111, 113 can be attached to bottoms of end walls 108, 110, but such extensions could be formed as part of end wall 108, 110 integrally in other embodiments. Such embodiments can accommodate any obstructions or imperfections on the floor of the roof gutter 10 by simply straddling or spanning such obstructions or imperfections. In addition, the extra height can afford adjustability of the end walls' effective height. For example, if end walls 108, 110 need to be shortened, the bottom edges thereof can be bent inward and/or outward, so that as the unit is pressed down in roof gutter 10, the bottom-facing surfaces of the bent end wall bottom edges engage gutter bottom wall 16. In addition, bottom edges of sidewalls 102, 104 can engage gutter front and/or back walls 12, 14 and/or bottom wall 16. In embodiments using separate extended portions 111, 113, they can be trimmed or attached with overlap as needed to yield the desired height in addition to or instead of being bent. Through this engagement of the bottom edges/surfaces of sidewalls 102, 104 and end walls 108, 110, guard 100 can seal tightly to gutter bottom wall 16 and/or gutter front and/or back walls 12, 14. Any water flowing to downspout 20 must thus pass through at least one wall of guard 100. Experiments were performed with a bottom portion extending 3/16" beyond bottom edges of sidewalls 102, 104, which was enough to clear obstructions in the gutter while maintaining contact with front gutter wall 12 in a K-style gutter, and the guard performed well. While this bottom portion size is preferred, it is expected that variations in this size would still be effective. For example, it is expected that a bottom portion in a range of from 1/8" to 1/4" should perform acceptably.

Regardless of the particular heights or lengths of bottom portions of end walls 108, 110, if any, guard 100 preferably has a height of approximately one half the height of gutter 10 to maintain maximum water flow and drainage capacity during heavy rains. The width of guard 100 should be selected based on the width of the gutter to ensure a snug fit between sidewalls 102, 104 and gutter front and back walls 12, 14. While guard 100 preferably has a length of from about 6 inches to about 8 inches for typical residential gutters of 5" and 6" size, other lengths, such as to accommodate other gutter sizes, can be used and are within the scope of the invention. The preferred length is a compromise between compactness and effectiveness since it is believed that effectiveness would vary with length of guard 100. That is, reducing length of guard 100 is expected to reduce its functionality, while increasing its length is expected to increase its functionality. Regardless of the particular length of top wall 106 and guard 100, an area of top wall 106 is preferably at least twice and area of an opening of downspout 20.

Figure 36:
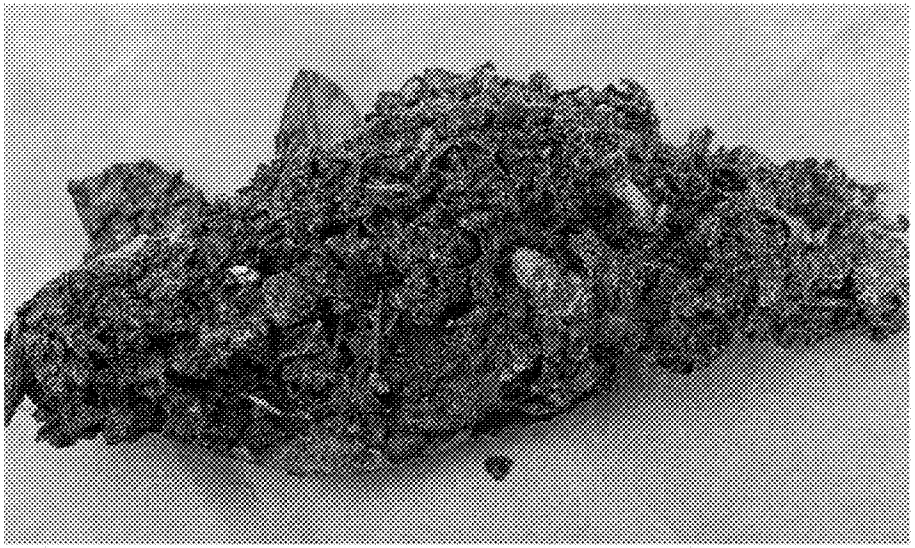
FIGS. 35-37 are photographs of an example of a downspout guard according to embodiments installed and in operation and illustrating filter cake formation.
Figure 35:
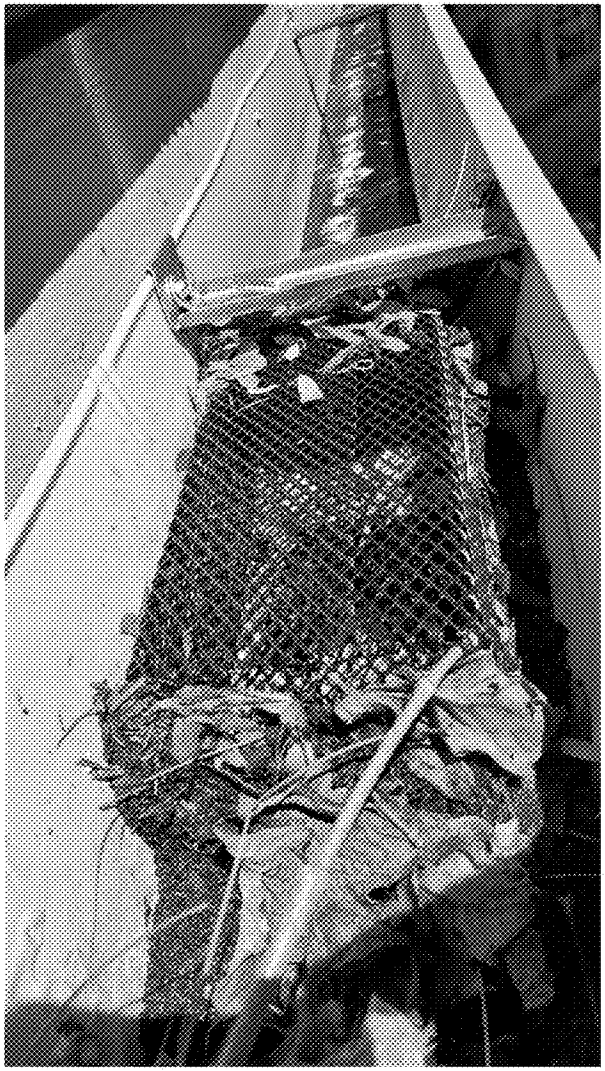
Figure 37:
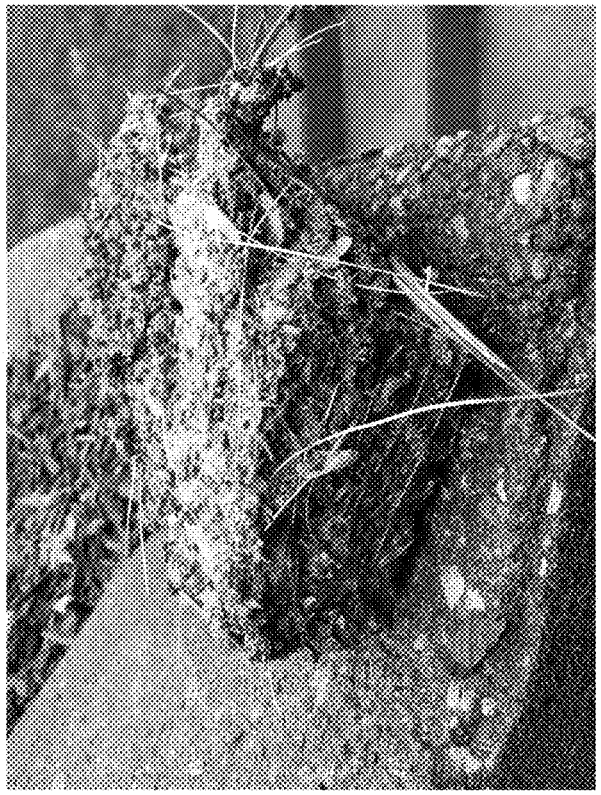
Figure 38:
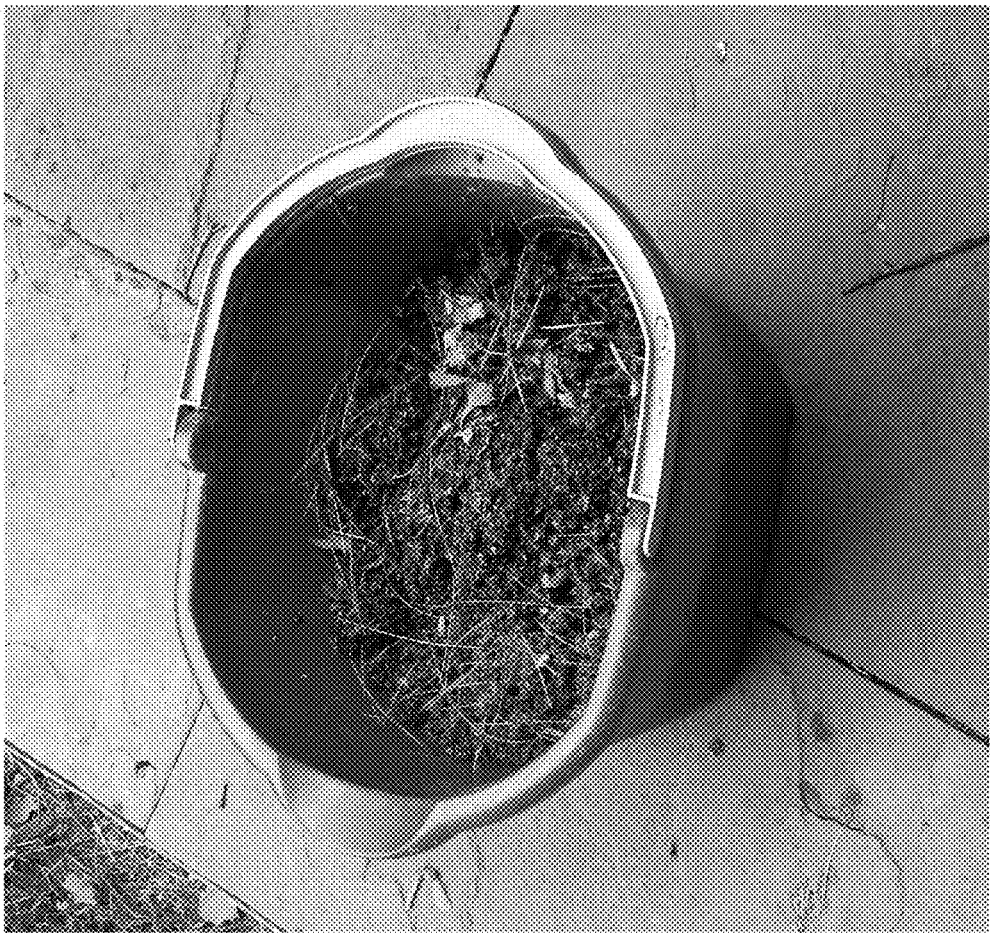
FIG. 38 is a photograph that shows debris collected by a downspout guard according to embodiments installed and in operation, including minute debris, such as dirt and roof shingle gravel.
Figure 40:
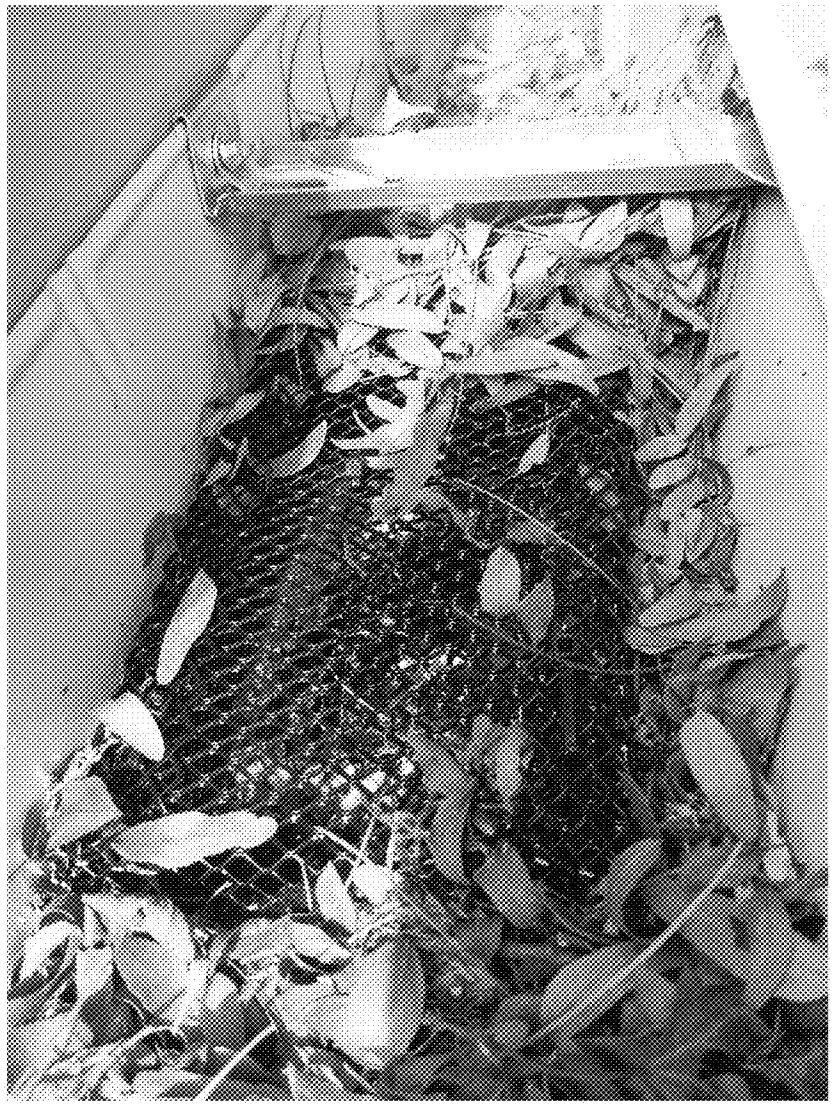
FIGS. 39-40 are photographs of examples of a downspout guard according to embodiments installed and in operation and blocking passage of larger debris, such as leaves.
Figure 39:
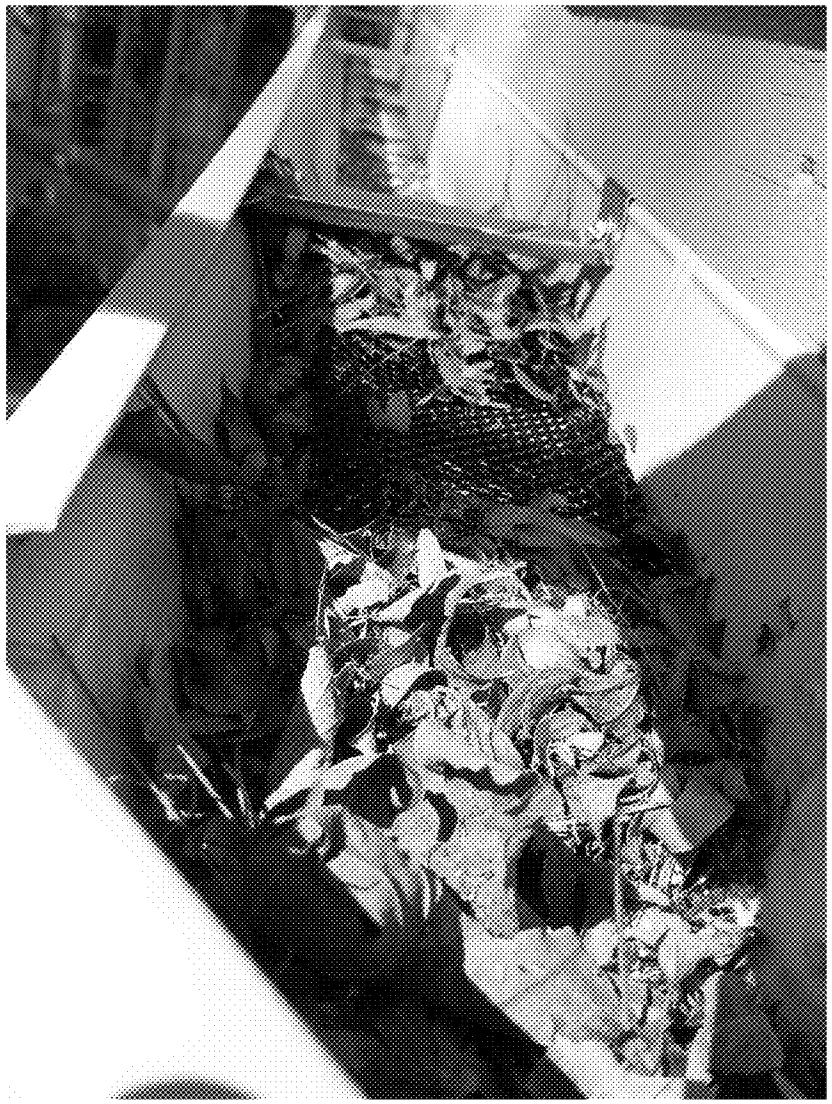
Figure 42:
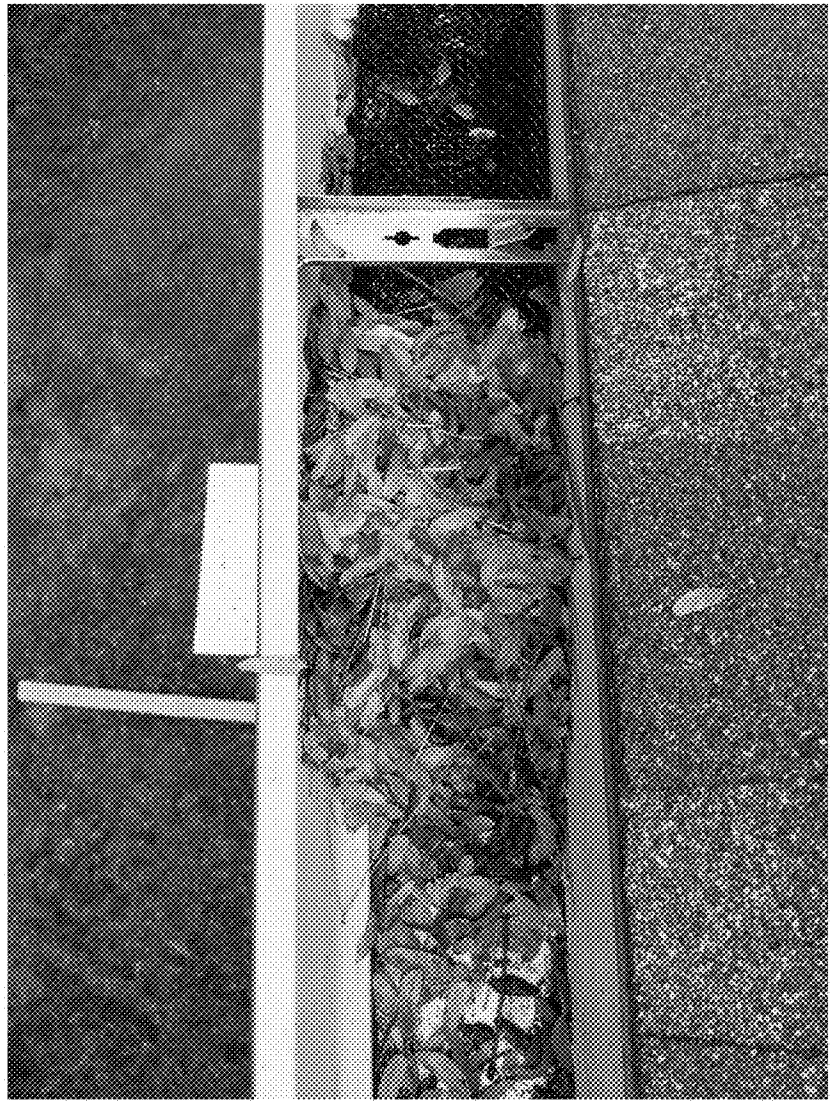
FIGS. 41-45 are photographs of examples of a downspout guard according to embodiments installed and in operation and blocking passage of small debris.
Figure 41:
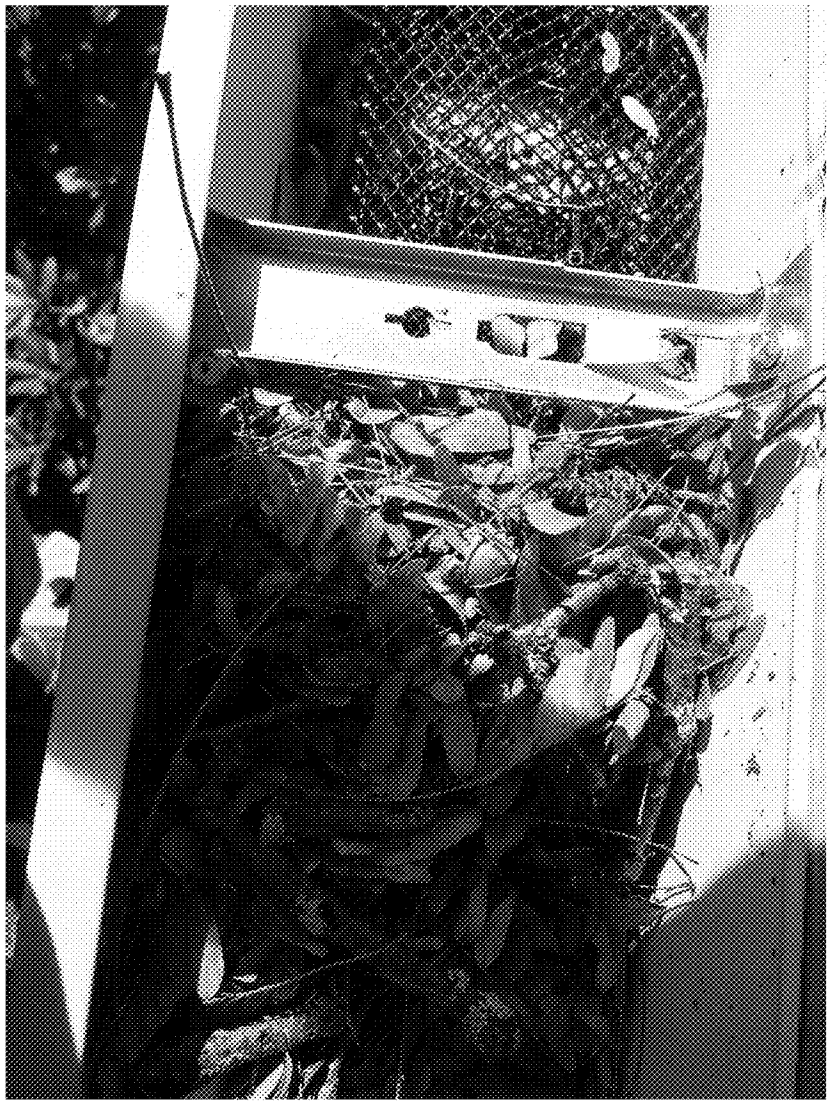
Figure 44:
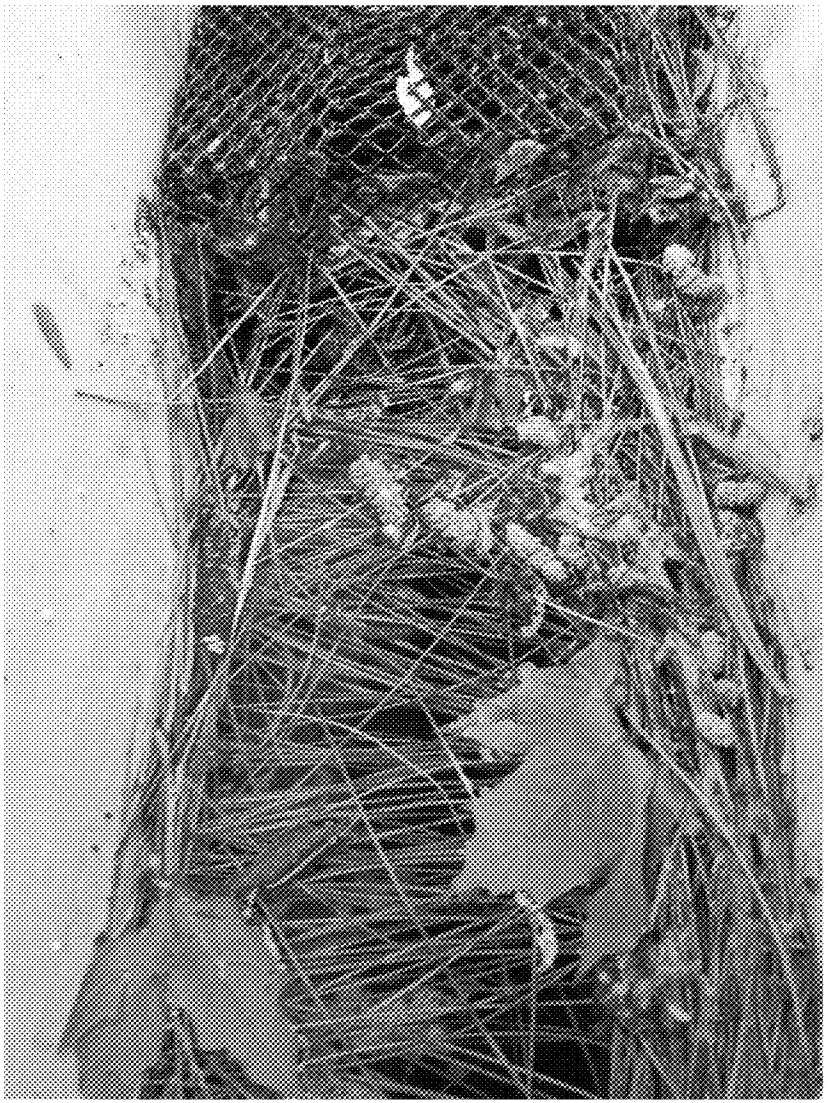
Figure 43:
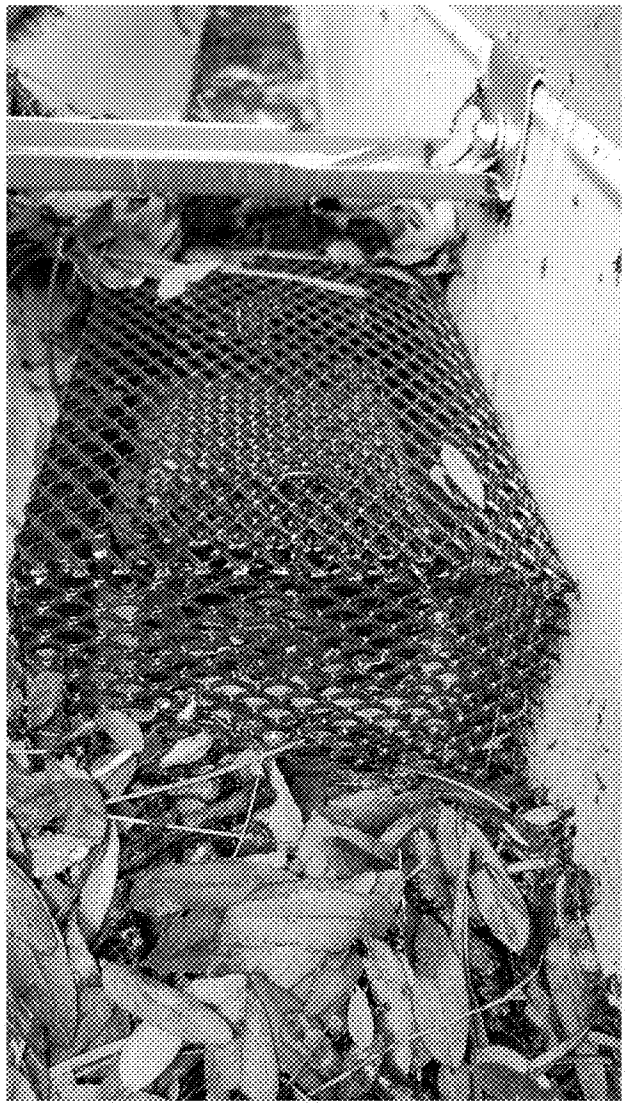
Figure 46:
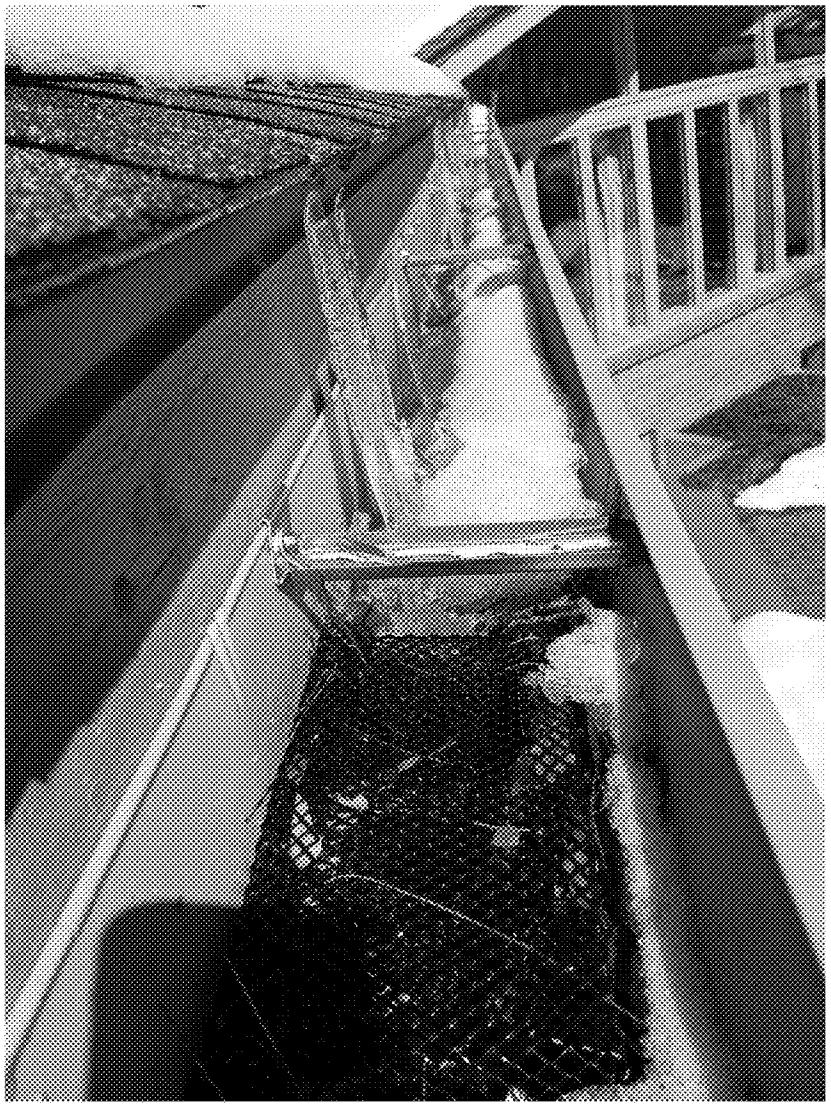
FIGS. 46-49 are photographs examples of a downspout guard according to embodiments installed and in operation during winter, illustrating its relationship to snow and ice.
Figure 45:
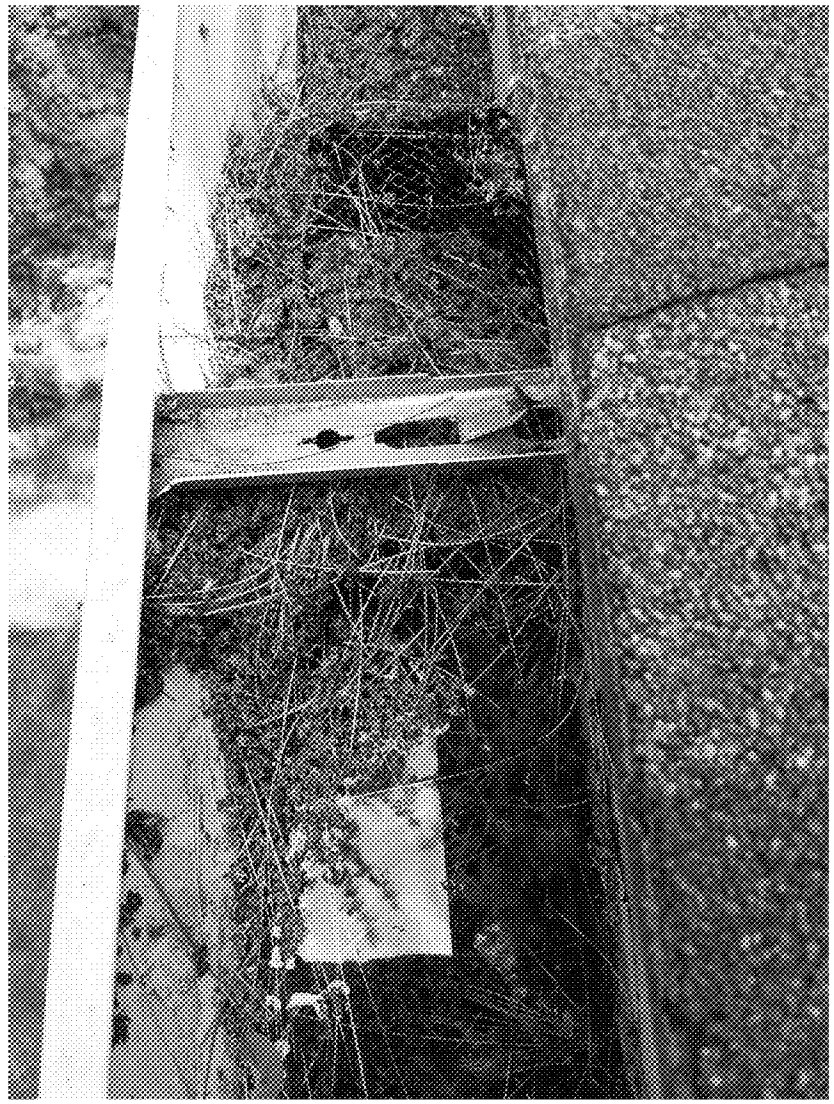
Figure 48:
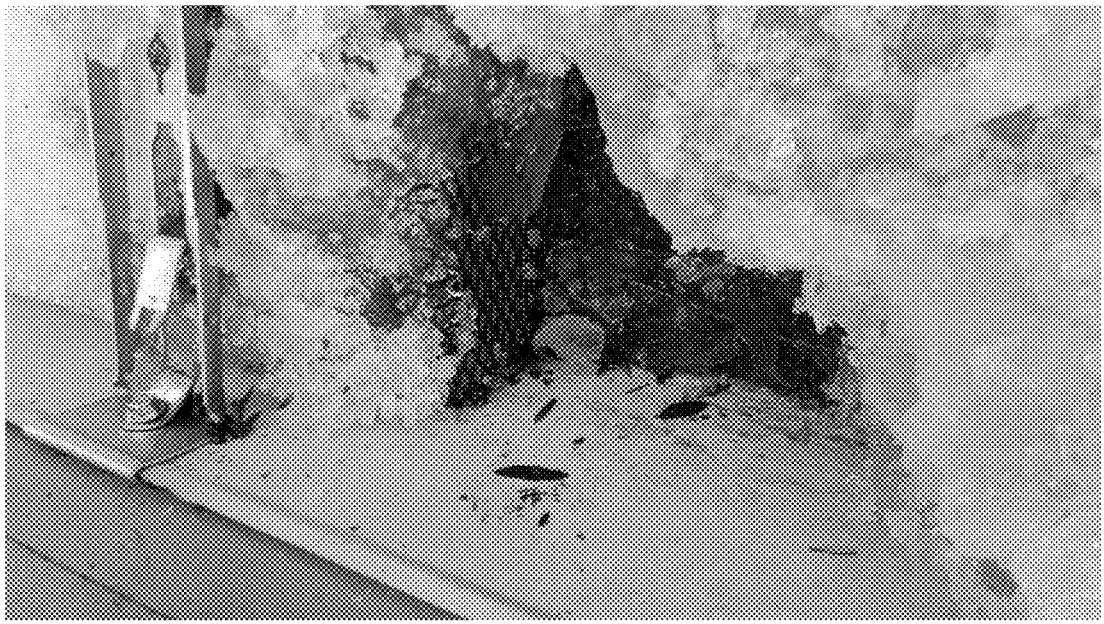
Figure 47:
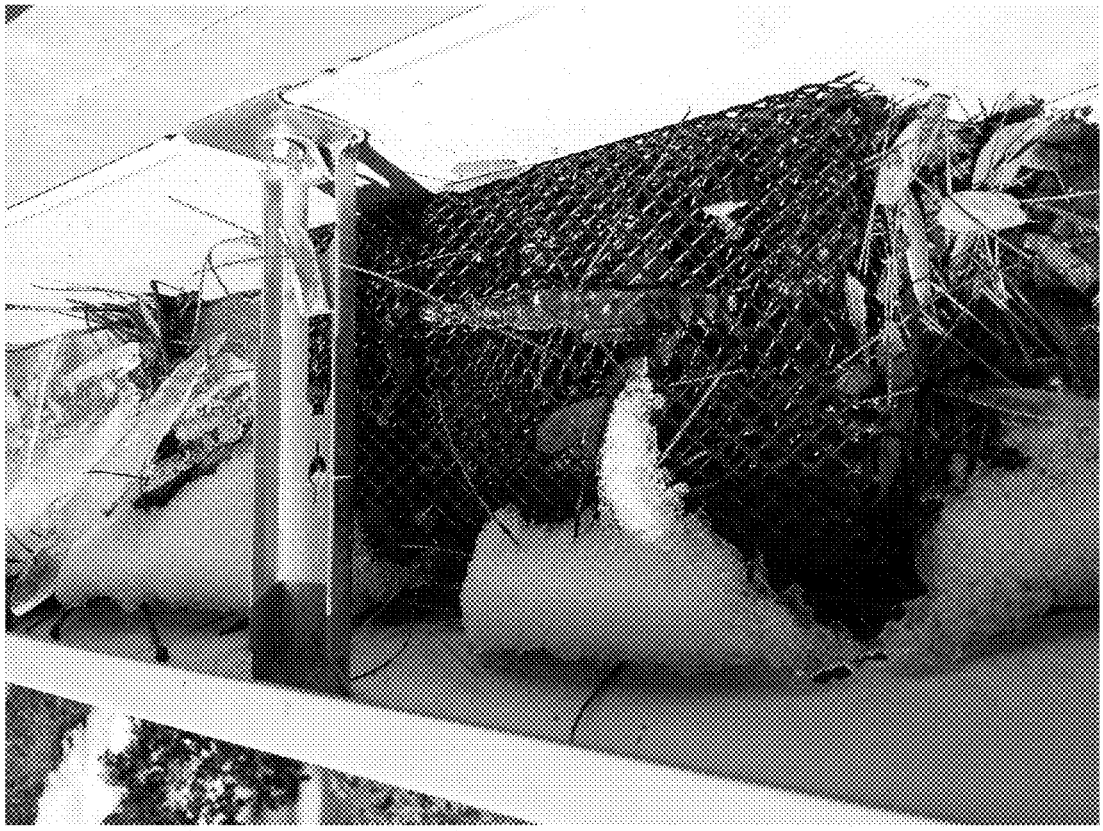
Figure 49:
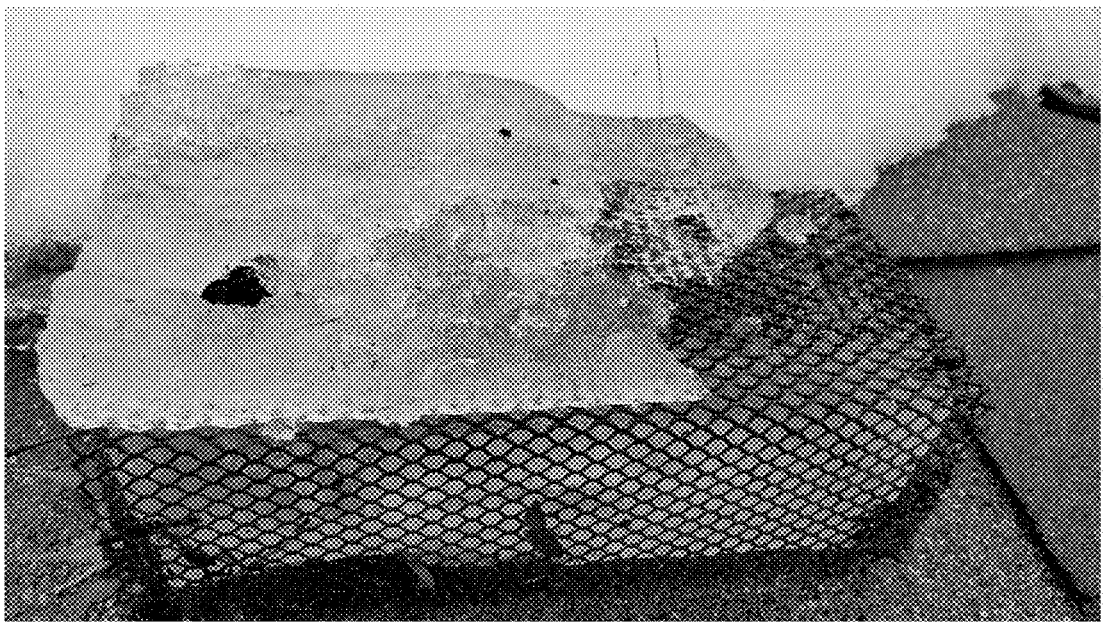

Debris piled against guard 100 can provide enhanced debris trapping and effectiveness as compared to that of prior art devices, as illustrated in FIGS. 35-49. More particularly, whereas prior art devices might filter or trap mainly large debris, such as that illustrated in FIGS. 39-43, embodiments of guard 100 can capture smaller debris, such as that seen in FIGS. 44 and 45, and even small particles or objects smaller than the mesh opening as shown in FIGS. 35-38. That is, the mesh of guard 100, particularly of end walls 108, 110 and particularly with characteristics in the ranges described, can act as a pre-filter that can trap small organic and inorganic material particles that can lead to the formation of a porous filter cake, as illustrated in FIGS. 35-37. This can enhance filtration, trapping roofing pebbles, seeds, particles as small as sand or soil particles, perhaps even smaller, such as spores, and preventing the trapped material from entering downspout 20. The filter cake (FIGS. 35-37) can become quite thick (FIG. 37) while still allowing flowthrough of water. Whether or not a filter cake forms can depend on the composition and placement of material in the gutter as the rains come. For example, there may be a filter cake without any leaves, a filter cake followed by a pileup of leaves, or simply a pileup of leaves. The pileup of leaves and other debris can extend quite a distance from the guard end walls along the gutter (FIGS. 42 and 45), such as a couple of feet or more, and can rise higher than the guard (FIGS. 39-41), and at times, even atop guard 100 without preventing water from entering downspout 20.

In operation, end walls 108, 110, and, particularly in a K-style gutter, a portion of front sidewall 102 above where it engages gutter front wall 12 can be primary drainage areas, particularly during light to moderate rainfall. When flow through guard 100 is reduced by debris buildup against the primary drainage areas, or when rainfall is heavy, top wall 106 can provide significant additional drainage area. In experiments, the top wall rarely became clogged, for debris will back up quite far from guard 100 in gutter 10, and debris pileup against the end walls could rise higher than the tops of the end walls before accumulating on the top wall. Given the amount of debris that can accumulate before downspout effectiveness is compromised, cleaning frequency can be significantly reduced. In addition, it has been observed that downspout guard 100 can reduce ice formation in a downspout.

Particularly with regard to the embodiment of FIG. 6, embodiments contemplate a method of making a downspout guard 100 including providing a sheet of a mesh material, forming a blank 100*d* including portions for sidewalls 102, 104 and end walls 108, 110 extending from a portion for top wall 106, and bending the wall portions into position to form downspout guard 100. In embodiments using a metal mesh material, forming a blank can include stamping, though other techniques fall within the scope of embodiments. The method may additionally include performing a powder coating process in embodiments using metal mesh material. Such a method is particularly suited to mass production of downspout guard 100 for sale in its final form.

Similar methods can be applied to produce other exemplary embodiments above, as well as kits for an end user to complete formation of downspout guard 100. For example, with reference to FIG. 6, the method can include forming a blank 100*d* with portions for sidewalls 102, 104, and portions for end walls 108, 110. To complete assembly, the method can include bending blank 100*b* along fold lines 103, 105 into a U- or squared-off-U-shape, and attaching end walls 108, 110 to sidewalls 102, 104. The manner of attachment can include welding, adhesive, mechanical fasteners, such as wire or plastic ties, or any other suitable methods. As above, in embodiments using metal mesh materials, the method can include performing a powder coating process.

With reference to FIGS. 7 and 8, a method of forming downspout guard 100 can include forming a first sheet of material 101*a* with portions for sidewalls 102, 104 extending from a first top wall portion 106*a*, forming a second sheet of material 101*b* with portions for end walls 108, 110 extending from a second top wall portion 106*b*. The first and second sheets of material 101*a*, 101*b*, can also be referred to as first and second blanks 101*a*, 101*b*. The method can further include orienting the two pieces of material 101*a*, 101*b* so that one of the top wall portions 106*a*, 106*b* overlies the other, as seen in FIG. 8, and bending first and second blanks 101*a*, 101*b* along fold lines 103, 105, 107, 109 to form sidewalls 102, 104 and end walls 108, 110. In embodiments, the method can preferably include connecting sidewalls 102, 104 and end walls 108, 110 to each other using welding, adhesive, mechanical fasteners, such as wire or plastic ties, or any other suitable methods. In embodiments using a metal mesh material, such as expanded metal mesh, the method can include performing a powder coating process, such as after bending. Embodiments using sufficiently heavy gauges of metal mesh material need not include connecting unless desired, though in some embodiments it may be advantageous to at least connect top wall portions 106*a*, 106*b* to each other.

With reference to FIG. 5, the method can include forming separate pieces of mesh material for opposed sidewalls 102, 104, top wall 106, and end walls 108, 110 as illustrated in arrangement 100*a*, placing tops of front and back sidewalls 102, 104 adjacent and perpendicular to top wall 106 along longer edges of top wall 106, placing tops of first and second end walls 108, 110 adjacent and perpendicular to top wall 106 along shorter edges of top wall 106, and connecting the pieces to form downspout guard 100. For example, the pieces can be connected by welding, adhesive, mechanical, such as wire or plastic ties, or any other suitable methods. Where a kit is desired, the method can include packaging the pieces and arranging and connecting can be left to the end user. In embodiments using metal mesh material, the method can include performing a powder coating process, which should be performed after connecting unless a kit is formed, in which case it should be performed after forming the pieces but before packaging the pieces. In embodiments using a plastic mesh material, forming a blank can including cutting or melting or other suitable processes. As with embodiments above using metal mesh, the method can preferably include fastening or connecting adjacent walls to each other after bending. Preferably, embodiments include ensuring each mesh opening of the mesh material of at least the opposed end walls has a diamond shape relative to the top wall, the diamond shape having a long axis substantially parallel to a plane of the top wall of the downspout guard.

With regard to the example shown in FIGS. 9-11, the method can include forming guard 100 by forming two guard portions 100*e*, 100*f*, one of which is larger than the other to allow sliding the smaller into the larger. With particular reference to FIG. 11, forming a first guard portion 100*e* can including forming a first blank 101*e* including material for sidewall 102, top wall portion 106*e*, and end wall portions 108*e*, 110*e*, then folding first blank 101*e* along fold lines 103*e*, 105*e*, 107*e* and attaching end wall portions 108*e*, 110*e* to top wall portion 106*e*. Forming a second guard portion 100*f* can include forming a second blank 101*f* including sidewall 104, top wall portion 106*f*, and end wall portions 108*f*, 110*f*, then folding second blank 101*f* along fold lines 103*f*, 105*f*, 107*f* and attaching end wall portions 108*f*, 110*f* to top wall portion 106*f*. The method can further include sliding one of first and second guard portions 100*e*, 100*f* inside the other to achieve a desired width of guard 100. Once the desired width is achieved, guard 100 is finished by attaching guard portions 100*e*, 100*f* to each other using any suitable method, such as those used to attach walls to each other in embodiments above. As with other embodiments, a kit can be provided including, for example, first and second guard portions 100*e*, 100*f*, either already assembled or in sheet form, as well as attachment devices to fix first and second guard portions 100*e*, 100*f* with respect to each other after an end user has assembled them into guard 100 with a desired width.

With regard to the alternate embodiment of FIG. 12-14, embodiments contemplate a method of making a downspout guard 200 including providing a sheet of a mesh material, forming at least three blanks each comprising respective pieces of mesh material 200*e*, 200*a*, 200*b*. A first piece of mesh material 200*e* can include top wall 206, first end wall 208, and second end wall 210, while a second piece of mesh material 200*a* can include front sidewall 202, and a third piece of mesh material 200*b* can include back sidewall 204. In embodiments, each of second and third pieces of mesh material 200*a*, 200*b* can further include respective first end wall tabs 208*a*, 208*b* and respective second end wall tabs 210*a*, 210*b*. The method can include bending the wall and tab portions into position to form downspout guard 200. In embodiments using a metal mesh material, forming a blank can include stamping, though other techniques fall within the scope of embodiments. The method may additionally include performing a powder coating process in embodiments using metal mesh material. Such a method is particularly suited to mass production of downspout guard 200 for sale in its final form, while also allowing for production of kits including the pieces of mesh material, either with tabs bent or with the pieces of mesh material flat.

With regard to the example of embodiments shown in FIGS. 15-18, a method of making a downspout guard 200 can include providing a sheet of a mesh material and forming at least three blanks each comprising respective pieces of mesh material. A first blank can include top wall 206, itself a first piece of mesh material, while second and third blanks can include second and third pieces of mesh material 200*a*, 200*b*. Second piece of mesh material 200*a* can include front sidewall 202, and a third piece of mesh material 200*b* can include back sidewall 204. In embodiments, each of second and third pieces of mesh material 200*a*, 200*b* can further include respective first end wall tabs 208*a*, 208*b* and respective second end wall tabs 210*a*, 210*b*. The method can further include providing fourth and fifth blanks including fourth piece of mesh material 200*c* and fifth piece of mesh material 200*d*. Fourth piece of mesh material 200*c* can include first end wall 208 and a first top wall tab 206*c*, while fifth piece of mesh material 200*d* can include second end wall 210 and a second top wall tab 206*d*. The method can include bending the wall and tab portions into position and aligning them to form downspout guard 200. In embodiments using a metal mesh material, forming a blank can include stamping, though other techniques fall within the scope of embodiments. The method may additionally include performing a powder coating process in embodiments using metal mesh material. Such a method is particularly suited to mass production of downspout guard 200 for sale in its final form, while also allowing for production of kits including the pieces of mesh material, either with tabs bent or with the pieces of mesh material flat.

Embodiments as described herein thus provide a downspout guard that can prevent even minute debris from entering the downspout, allow a larger buildup of debris without significantly diminishing water drainage, requires fewer instances of cleaning the guard and the gutter, is easy to install and remove when it does need cleaning, is safe for hands and gutters, and is adjustable to ensure a tight fit.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A downspout guard comprising:

a housing consisting of five walls that each extend and are formed to be uninterrupted from edge to edge of each of the walls and consist of: a front sidewall and a back sidewall; two opposed end walls; and a top wall connected to the front and back sidewalls and the end walls, wherein a space between the two opposed side walls and the two opposed end walls and extending away from the top wall is completely open and without a wall across the bottom of the downspout guard, wherein the five walls each extend and are formed to be uninterrupted from edge to edge of each of the walls and each of the sidewalls and the end walls continuously extending perpendicularly from the top wall to a continuous linear bottom edge of each of the sidewalls and the end walls configured to engage a gutter bottom wall to hold the guard in place and force any water to flow through one or more of the five walls before entering the downspout, wherein each of the end walls extends entirely along a corresponding vertical plane and each comprises a mesh material configured with a ratio of open area between 60% to 65% and with mesh openings that each have a diamond shape with a short way of design of no more than 0.25" and a long way of design of no more than 0.40" that provides filtration and blocks the passage of debris and particles smaller than the mesh openings and creates a filter cake outside of the downspout guard;

wherein when installed in a gutter that includes opposed front and back walls connected to a bottom wall, bottom surfaces of at least the end walls are sized to engage the gutter bottom wall.

2. The downspout guard of claim 1, wherein when installed in a gutter that includes opposed front and back walls connected to a bottom wall, the front and back sidewalls which each extend entirely along a corresponding vertical plane and the end walls of the downspout guard are each sized to provide an interference fit with the respective front and back walls of the gutter.

3. The downspout guard of claim 1, wherein the front and back sidewalls and the top wall are formed from a single piece of material.

4. The downspout guard of claim 3, wherein the single piece of material further includes the two opposed end walls, wherein the two opposed end walls remain attached to the single piece of material.

5. The downspout guard of claim 3, wherein a second piece of material includes the two opposed end walls and another wall substantially identical to the top wall in size and shape such that when the single piece of material and the second piece of material are placed with the top wall and the another wall aligned and engaging each other and the two opposed end walls are bent so that the second piece of material forms a U-shape, the two opposed end walls are substantially perpendicular to the front and back sidewalls and to the top wall and the another wall.

6. The downspout guard of claim 1, wherein the mesh material of at least the opposed end walls has a diamond pattern relative to a plane of the top wall of the downspout guard, the diamond pattern being oriented such that a long axis of each diamond of the pattern is parallel to the plane of the top wall of the downspout guard.

7. The downspout guard of claim 6, wherein the mesh material includes a metal.

8. The downspout guard of claim 7, wherein the metal is powder coated.

9. The downspout guard of claim 7, wherein the mesh material includes an expanded metal.

10. The downspout guard of claim 1, wherein each end wall has a height that is greater than a height of the two opposed sidewalls, a bottom portion of each end wall extending below bottom edges of the side walls by from −8 to −4 substantially coplanar with the respective one of the two opposed end walls and including a respective bottom surface that engages the gutter bottom wall when the downspout guard is installed.

11. The downspout guard of claim 10, wherein each bottom portion is a separate piece of mesh material attached to a bottom of a respective end wall.

12. The downspout guard of claim 10, wherein the height of each of the downspout guard is adjusted by changing an angle of a respective bottom portion of each end wall relative to the respective end wall.

13. The downspout guard of claim 1, wherein the downspout guard includes first and second guard portions each formed from respective first and second sheets of material, each of the first and second sheets of material including respective ones of the opposed sidewalls, respective portions of the top wall, and respective portions of the opposed end walls, one of the first and second portions being smaller than the other and slidingly positioned inside the other of the first and second guard portions, thereby allowing adjustment of a width of the downspout guard.

14. The downspout guard of claim 1, wherein during operation a retainer is attached to at least one of the five walls to hold the guard in position.

15. The downspout guard of claim 14 wherein the retainer extends into the downspout.

16. The downspout guard of claim 14, wherein the retainer is also attached to a part of a gutter in which the guard is installed.

17. A downspout guard comprising:

a housing consisting of five walls that each extend and are formed to be uninterrupted from edge to edge of each of the walls and consist of: two opposed sidewalls including a front sidewall and a back sidewall; two opposed end walls; and a top wall connected to the sidewalls and end walls;

wherein a space between the front sidewall, the back sidewall, the two opposed end walls and the top wall remains completely open and without a wall across the bottom of the downspout guard, thereby enabling at least one of the two opposed sidewalls and the two opposed end walls to have a height that is different than a height of at least one other of the two opposed sidewalls and the two opposed end walls and wherein, when installed in a gutter that includes a bottom wall, bottom surfaces of at least the end walls engage the gutter bottom wall;

wherein the five walls each extend and are formed to be uninterrupted from edge to edge of each of the walls and each of the sidewalls and the end walls extending perpendicularly from the top wall to a continuous linear bottom edge of each of the sidewalls and the end walls configured to engage a gutter bottom wall to hold the guard in place and force any water to flow through one or more of the five walls before entering a downspout;

wherein each of the end walls and each of the side walls extends entirely along a corresponding vertical plane and each comprises a mesh material configured with a ratio of open area between 60% to 65% and with mesh openings that each have a diamond shape with a short way of design of no more than 0.25" and a long way of design of no more than 0.40" that blocks debris and particles smaller than the mesh openings and creates a filter cake outside of the downspout guard;

wherein, when installed in a gutter that includes a bottom wall, bottom surfaces of at least the end walls engage the gutter bottom wall.

18. The downspout guard of claim 17, wherein a longitudinal axis of each opening of the mesh material of the two opposed end walls is substantially parallel to the plane of the top wall of the downspout guard.

19. The downspout guard of claim 17, wherein the mesh material is an expanded metal mesh.

20. The downspout guard of claim 17, wherein the at least one piece of material includes a single piece of material from which the top wall, the two opposed sidewalls, and end walls are formed, remaining attached thereto, and end wall tabs are formed on and remain attached to respective ends of the two opposed sidewalls.

21. The downspout guard of claim 17, wherein the end walls and side walls of the downspout guard are each sized to provide an interference fit with front and back walls of the gutter.

* * * * *